US010916210B2

(12) United States Patent
Suzuki

(10) Patent No.: US 10,916,210 B2
(45) Date of Patent: Feb. 9, 2021

(54) DISPLAY APPARATUS AND LIGHT CONTROL APPARATUS

(71) Applicant: Japan Display Inc., Tokyo (JP)

(72) Inventor: Daichi Suzuki, Tokyo (JP)

(73) Assignee: Japan Display Inc., Tokyo (JP)

( * ) Notice: Subject to any disclaimer, the term of this patent is extended or adjusted under 35 U.S.C. 154(b) by 8 days.

(21) Appl. No.: 16/414,311

(22) Filed: May 16, 2019

(65) Prior Publication Data

US 2019/0355321 A1 Nov. 21, 2019

(30) Foreign Application Priority Data

May 21, 2018 (JP) ..... 2018-097400

(51) Int. Cl.
*G09G 3/36* (2006.01)

(52) U.S. Cl.
CPC ... *G09G 3/3648* (2013.01); *G09G 2300/0426* (2013.01); *G09G 2320/0626* (2013.01)

(58) Field of Classification Search
CPC ..... G09G 3/3648; G09G 2300/0426; G09G 2320/0626; G09G 2310/0297; G09G 2300/023
See application file for complete search history.

(56) References Cited

U.S. PATENT DOCUMENTS

2016/0188063 A1* 6/2016 Kim ..... G02F 1/13338 345/173
2016/0260401 A1* 9/2016 Sakaigawa ..... G09G 3/3607
2018/0231836 A1 8/2018 Suzuki et al.
2020/0089052 A1* 3/2020 Chen ..... G09G 3/3426

FOREIGN PATENT DOCUMENTS

JP 2013-161053 A 8/2013

* cited by examiner

*Primary Examiner* — Amit Chatly
(74) *Attorney, Agent, or Firm* — Michael Best & Friedrich LLP

(57) ABSTRACT

According to an aspect, a display apparatus includes: a display device that includes a display area in which a plurality of pixels are provided; an illuminator that includes a light guiding plate opposed to the display area and a light source configured to emit light to the light guiding plate; and a light controller configured to adjust an amount of light emitted from the illuminator. The light controller includes: a first substrate provided with a plurality of light control areas opposed to the display area; a plurality of electrodes arranged in a matrix in each of the light control areas; circuitry configured to control light transmittance of each of the light control areas; and a plurality of wiring lines that couple the circuitry and the electrodes.

16 Claims, 13 Drawing Sheets

DISPLAY APPARATUS AND LIGHT CONTROL APPARATUS

CROSS-REFERENCE TO RELATED APPLICATIONS

This application claims priority from Japanese Application No. 2018-097400, filed on May 21, 2018, the contents of which are incorporated by reference herein in its entirety.

BACKGROUND

1. Technical Field

What is disclosed herein relates to a display apparatus and a light control apparatus.

2. Description of the Related Art

A liquid crystal display apparatus having what is called a local dimming function has been known (see Japanese Patent Application Laid-open Publication No. 2013-161053). With the local dimming control, backlight-driving control is performed so as to change the intensity of light to be emitted from a backlight in accordance with the brightness of an image that is displayed.

The conventional backlight-driving control does not, however, limit the area that the light from a light source of the backlight reaches. For this reason, unnecessary light is provided in some areas.

SUMMARY

According to an aspect of the present disclosure, a display apparatus includes: a display device that includes a display area in which a plurality of pixels are provided; an illuminator that includes a light guiding plate opposed to the display area and a light source configured to emit light to the light guiding plate; and a light controller configured to adjust an amount of light emitted from the illuminator. The light controller includes: a first substrate provided with a plurality of light control areas opposed to the display area; a plurality of electrodes arranged in a matrix in each of the light control areas; circuitry configured to control light transmittance of each of the light control areas; and a plurality of wiring lines that couple the circuitry and the electrodes.

According to another aspect of the present disclosure, a light control apparatus includes: a first substrate provided with a plurality of light control areas; a plurality of electrodes arranged in a matrix in each of the light control areas; circuitry configured to control light transmittance of each of the light control areas; and a plurality of wiring lines that couple the circuitry and the electrodes.

DETAILED DESCRIPTION

Figure 1:
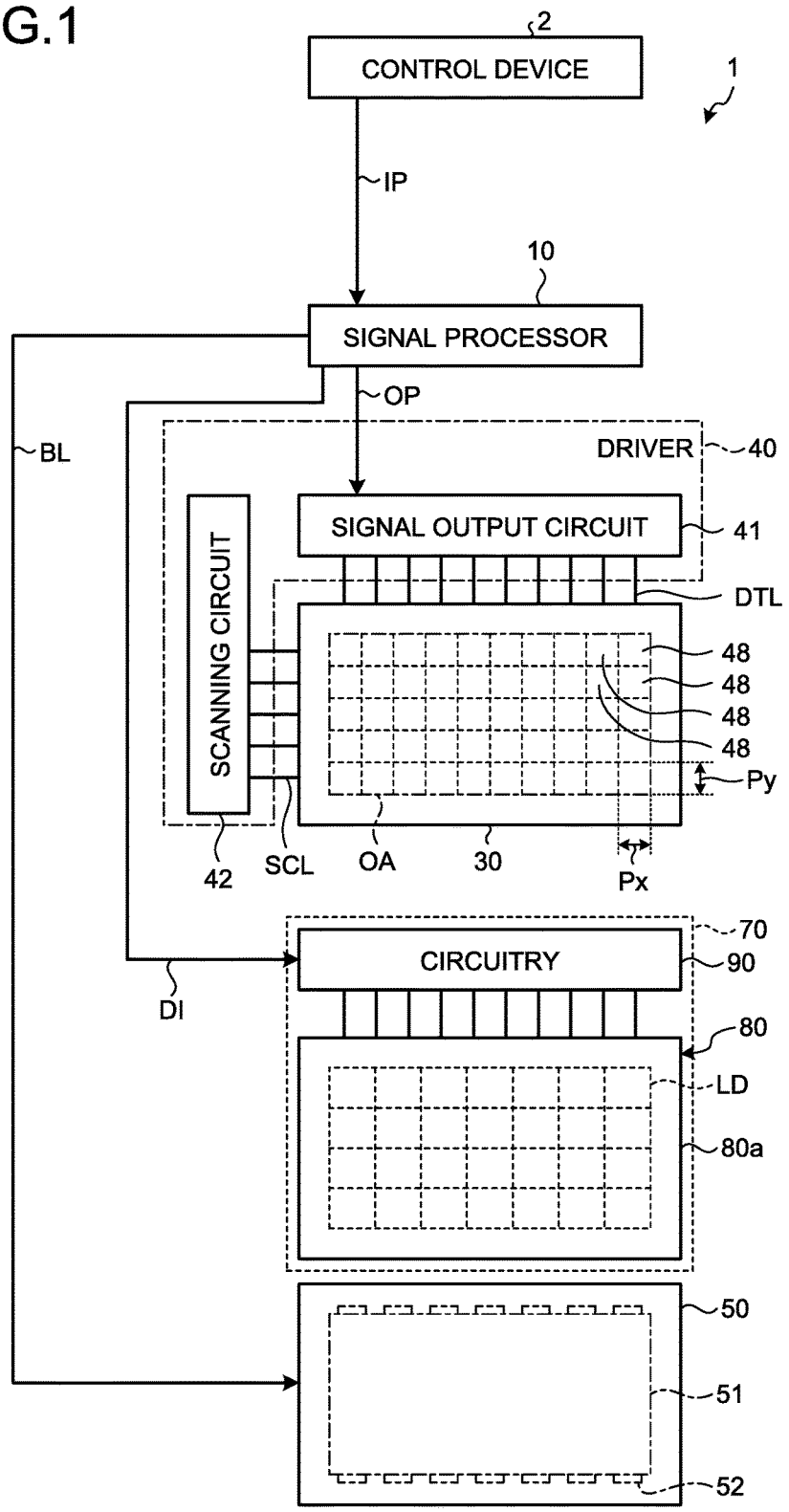
FIG. 1 is a diagram illustrating an example of the main configuration of a display apparatus according to a first embodiment.

A mode (embodiment) for carrying out the present disclosure will be described in detail with reference to the drawings. Contents that are described in the following embodiments do not limit the present disclosure. Components that are described below include components that those skilled in the art can easily envisage and are substantially the same components. Furthermore, the components that are described below can be appropriately combined. The present disclosure is merely an example and it is needless to say that appropriate changes while maintaining the gist of the present disclosure at which those skilled in the art can easily arrive are encompassed in the scope of the present disclosure. The drawings are schematically illustrated for the widths, the thicknesses, the shapes, and the like of respective parts relative to actual modes in order to make the description more clear, in some cases. The drawings are, however, merely examples and do not limit interpretation of the present disclosure. In the present specification and the drawings, the same reference numerals denote the same components described before with reference to the drawings that have been already referred to and detailed description thereof is appropriately omitted in some cases.

In this disclosure, when an element is described as being "on" another element, the element can be directly on the other element, or there can be one or more elements between the element and the other element.

First Embodiment

FIG. 1 is a diagram illustrating an example of the main configuration of a display apparatus according to a first embodiment. A display apparatus 1 in the embodiment includes a signal processor 10, a display device 30, a driver 40, an illuminator 50, and a light controller 70. The signal processor 10 performs various outputs based on an input signal IP input from an external control device 2. The input signal IP is a signal for displaying an image on the display apparatus 1 and is, for example, an RGB image signal. The signal processor 10 generates an image signal OP based on the input signal IP. The signal processor 10 outputs the image signal OP to the display device 30 through the driver 40. The signal processor 10 generates a light control signal (dimming control signal) DI based on the input signal IP. The signal processor 10 outputs the light control signal DI to the light controller 70. When the input signal IP is input, the signal processor 10 outputs, to the illuminator 50, a light source drive signal BL for operating the illuminator 50. The signal processor 10 is, for example, an integrated circuit such as a field-programmable gate array (FPGA).

The display device 30 has a display area OA in which a plurality of pixels 48 are provided. The pixels 48 are arranged, for example, in a matrix (row-column configuration). The display device 30 in the embodiment is a liquid crystal display panel. The driver 40 includes a signal output circuit 41 and a scanning circuit 42. The signal output circuit 41 drives the pixels 48 in accordance with the image signal OP. The scanning circuit 42 scans the pixels 48 arranged in a matrix (row-column configuration) on a predetermined number of rows basis (for example, on a row basis). The driver 40 drives the pixels 48 such that gradation values in accordance with the image signal OP are output. The shape of the display device 30 is not limited to a rectangular shape when viewed in plan and may have a circular shape, an oval shape, an irregular shape formed by removing a part of any of these outer shapes, or the like. The shape of the display device 30 is not limited to a flat plate shape and, for example, at least one of the display area OA and a frame area provided outside the display area OA may have a curved surface.

The illuminator 50 includes a light guiding plate 51 and a plurality of light sources 52. The light guiding plate 51 is arranged overlapping with the display area OA when the display area OA is viewed in plan. In other words, the light guiding plate 51 is opposed to the display area OA. The light sources 52 are arranged on the side surfaces of the light guiding plate 51. The illuminator 50 emits light from the light sources 52 as planar light from the surface of the light guiding plate 51. The illuminator 50 thereby illuminates the entire display area OA from its rear surface side. The expression "when viewed in plan" indicates the case when viewed in the direction perpendicular to the surface of a first substrate 83 (see FIG. 9) of a light control panel 80.

The light controller 70 adjusts the amount of light emitted from the illuminator 50 and irradiates the display device 30 with the adjusted light. The light controller 70 includes the light control panel 80 and circuitry 90. The light control panel 80 includes a lower substrate 80*a* and an upper substrate 80*b* (see FIG. 2). A plurality of light control areas LD are provided in the light control panel 80. The light control areas LD are provided overlapping with the display area OA when viewed in plan. In other words, the light control areas LD are opposed to the display area OA. Each of the light control areas LD is capable of changing the transmittance of the light passing therethrough. The circuitry 90 individually controls the light transmittance of each of the light control areas LD in accordance with the light control signal DI.

Figure 2:
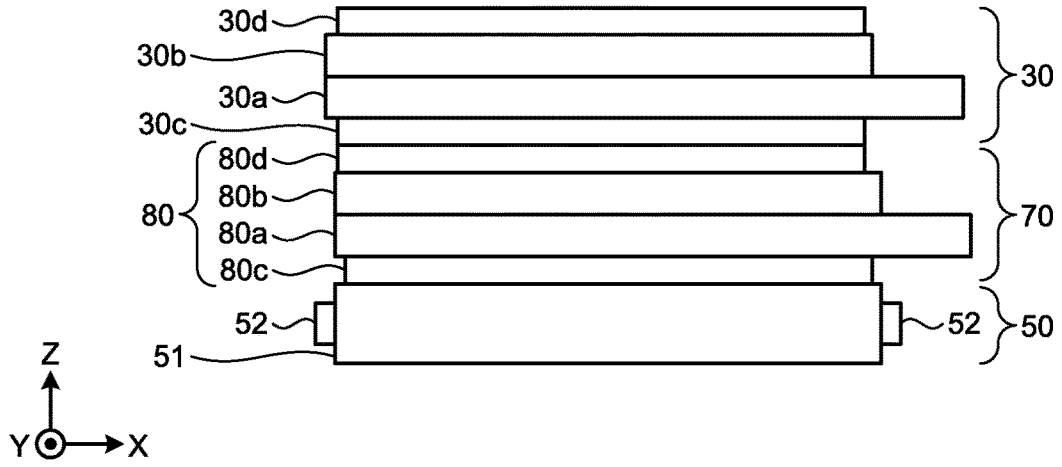
FIG. 2 is a diagram illustrating an example of a positional relation between a display device, a light controller, and an illuminator.

FIG. 2 is a diagram illustrating an example of a positional relation between the display device, the light controller, and the illuminator. FIG. 2 illustrates the light control panel 80 of the light controller 70. As illustrated in FIG. 2, the display device 30, the light controller 70, and the illuminator 50 are stacked in this order. To be specific, the light control panel 80 is stacked on the side of an emitting surface from which the illuminator 50 emits light. The display device 30 is stacked on a first side of the light control panel 80, the first side being opposite to a second side of the light control panel 80 facing the illuminator 50. In other words, the light controller 70 is located between the display device 30 and the illuminator 50. The light emitted from the illuminator 50 is controlled in amount by the light control areas LD of the light control panel 80 and then illuminates the display device 30. The display device 30 is illuminated from its rear surface side on which the illuminator 50 is located and displays and outputs an image on its side (on the display surface side) opposed to the rear surface side. Thus, the illuminator 50 functions as backlight that illuminates the display area OA of the display device 30 from the rear surface.

In the following description, the direction in which the display device 30, the light controller 70, and the illuminator 50 are stacked is assumed to be a Z direction. Two directions orthogonal to the Z direction are assumed to be an X direction and a Y direction. The X direction and the Y direction are orthogonal to each other.

As illustrated in FIG. 2, the display device 30 includes an array substrate 30*a* and a counter substrate 30*b*. The counter substrate 30*b* is arranged so as to face the array substrate 30*a*. As will be described later, a liquid crystal layer LC1 is arranged between the array substrate 30*a* and the counter substrate 30*b* (see FIG. 4). A polarizing plate 30*c* is provided on the rear surface side of the array substrate 30*a*. A polarizing plate 30*d* is provided on the display surface side of the counter substrate 30*b*.

The light control panel 80 includes the lower substrate 80*a*, the upper substrate 80*b*, a polarizing plate 80*c*, and a polarizing plate 80*d*. The upper substrate 80*b* is located on the display surface side relative to the lower substrate 80*a* and faces the lower substrate 80*a*. As will be described later, a liquid crystal layer LC2 is arranged between the lower substrate 80*a* and the upper substrate 80*b* (see FIG. 9). The polarizing plate 80*c* is provided on the rear surface side of the lower substrate 80*a*. The polarizing plate 80*d* is provided on the display surface side of the upper substrate 80*b*. One of the polarizing plate 80*d* and the polarizing plate 30*c* may double as the other one. That is to say, one polarizing plate 30*c* may be provided between the array substrate 30*a* and the upper substrate 80*b* without providing the polarizing plate 80*d*.

The light controller 70 is located between the display device 30 and the illuminator 50 and can therefore control the light amount between the display device 30 and the illuminator 50, thereby ensuring local dimming accuracy more easily.

Figure 3:
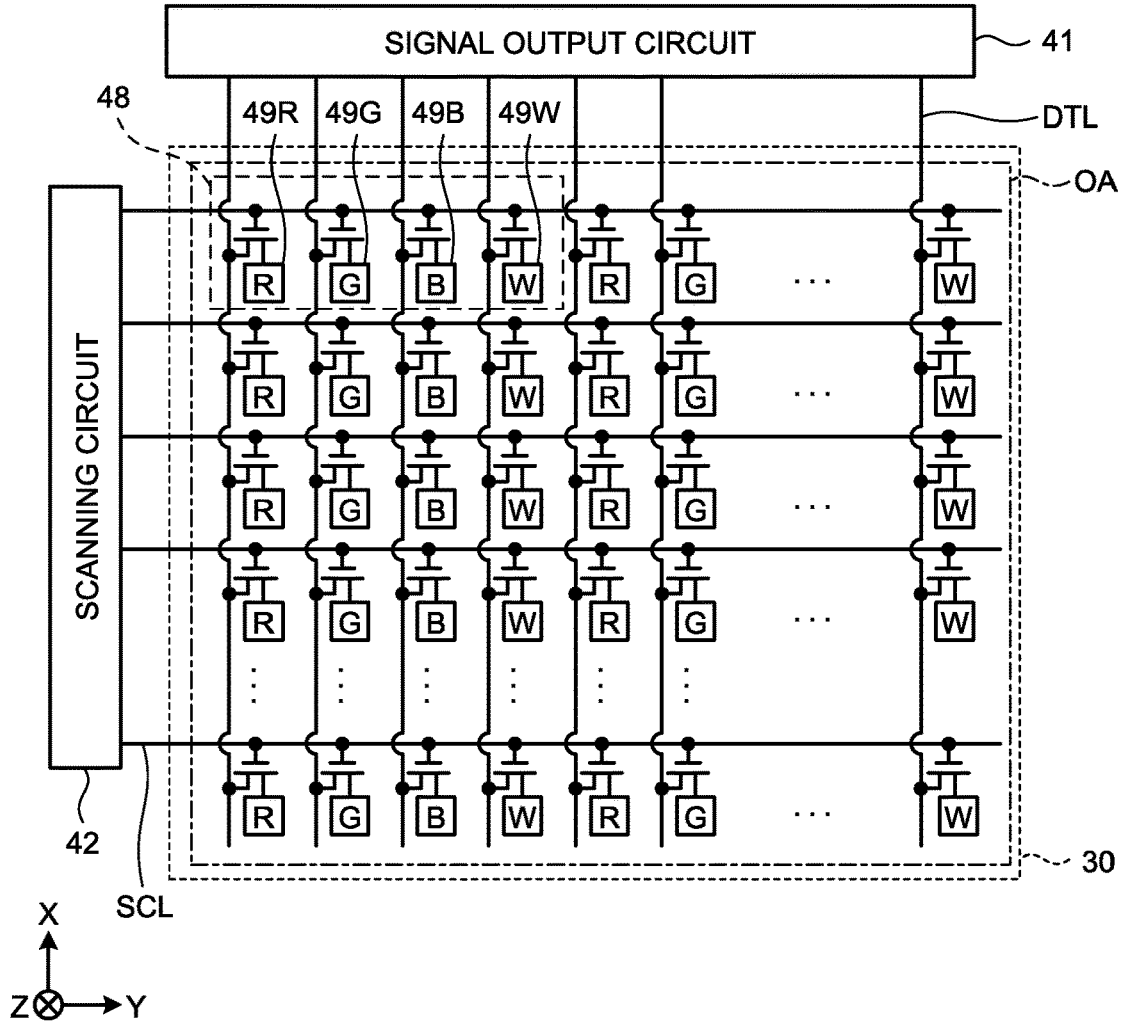
FIG. 3 is a diagram illustrating an example of a pixel array on the display device.

FIG. 3 is a diagram illustrating an example of a pixel array on the display device. As illustrated in FIG. 3, the pixels 48 are arrayed in a matrix (row-column configuration) along the X direction and the Y direction. The pixel 48 includes, for example, a first subpixel 49R, a second subpixel 49G, a third subpixel 49B, and a fourth subpixel 49W. The first subpixel 49R displays a first primary color (for example, red). The second subpixel 49G displays a second primary color (for example, green). The third subpixel 49B displays a third primary color (for example, blue). The fourth subpixel 49W displays a fourth color (specifically, white). The colors that the first subpixel 49R, the second subpixel 49G, the third subpixel 49B, and the fourth subpixel 49W display are not limited to the first primary color, the second primary color, the third primary color, and white, respectively. It is sufficient that the colors are different from one another, and the colors may be complementary colors or the like. In the following description, the first subpixels 49R, the second subpixels 49G, the third subpixels 49B, and the fourth subpixels 49W are referred to as subpixels 49 when they are not required to be distinguished from one another. The colors of the pixels 48 are not limited to the four colors. The colors of the pixels 48 may be equal to or more than five colors or equal to or less than three colors. The colors of the pixels 48 may be, for example, three colors of red, blue, and green.

The display apparatus 1 is a transmissive color liquid crystal display apparatus more specifically. As illustrated in FIG. 3, the display device 30 is a color liquid crystal display panel, and color filters are arranged thereon corresponding to the subpixels 49.

As illustrated in FIG. 3, the signal output circuit 41 is electrically coupled to the display device 30 with signal lines DTL. The scanning circuit 42 is electrically coupled to the display device 30 with scanning lines SCL. The scanning circuit 42 selects the subpixels 49 on the display device 30 and controls ON and OFF of switching elements for controlling operations (light transmittances) of the subpixels 49. The switching elements are, for example, thin film transistors (TFT). In the first embodiment, the scanning lines SCL are along the Y direction and the signal lines DTL are along the X direction. This, however, is merely an example of the directions in which the scanning lines SCL and the signal lines DTL extend, and the directions are not limited thereto and can be appropriately changed.

Figure 4:
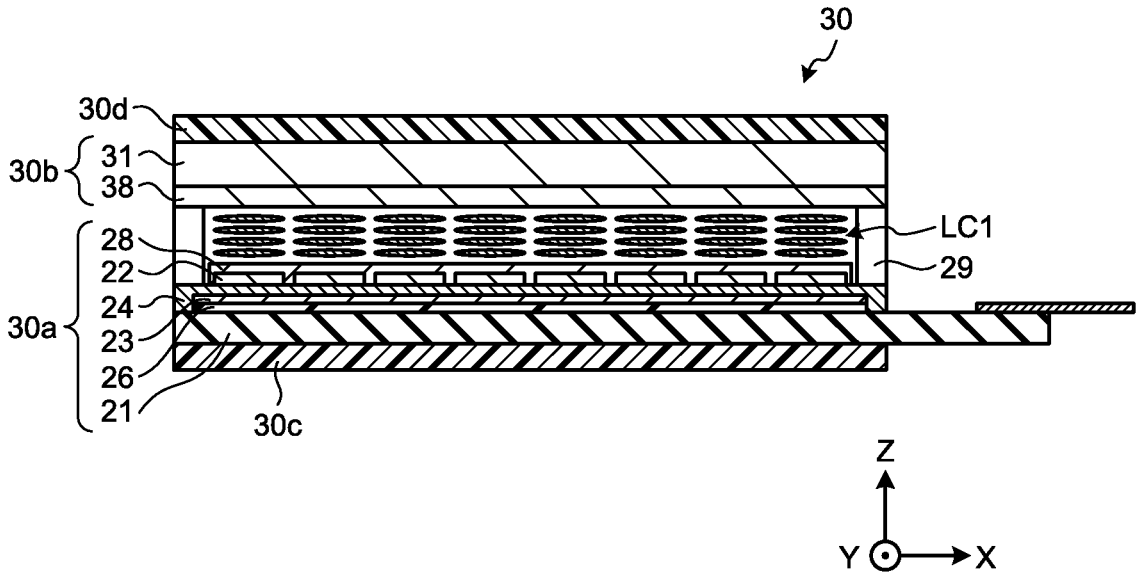
FIG. 4 is a cross-sectional view illustrating an example of the schematic cross-sectional configuration of the display device.

FIG. 4 is a cross-sectional view illustrating an example of the schematic cross-sectional configuration of the display device. The array substrate 30*a* includes a pixel substrate 21, a filter film 26, a counter electrode 23, an insulating film 24, pixel electrodes 22, and a first orientation layer 28. The pixel substrate 21 is, for example, a glass substrate. The counter electrode 23 is provided on the upper side of the pixel substrate 21. The filter film 26 is provided between the pixel substrate 21 and the counter electrode 23. The insulating film 24 is provided on the counter electrode 23 in a contact manner. The pixel electrodes 22 are provided on the upper side of the insulating film 24. The first orientation layer 28 is provided on the uppermost surface side of the array substrate 30*a*. The polarizing plate 30*c* is provided on the lower surface of the pixel substrate 21.

The counter substrate 30*b* includes a counter pixel substrate 31 and a second orientation film 38. The counter pixel substrate 31 is, for example, a glass substrate. The second orientation film 38 is provided on the lower surface of the counter pixel substrate 31. The polarizing plate 30*d* is provided on the upper surface of the counter pixel substrate 31.

The array substrate 30*a* and the counter substrate 30*b* are fixed to each other with a seal member 29 interposed therebetween. The liquid crystal layer LC1 is sealed in a space surrounded by the array substrate 30*a*, the counter substrate 30*b*, and the seal member 29. The liquid crystal layer LC1 contains liquid crystal molecules that change in orientation direction in accordance with an electric field applied thereto. The liquid crystal layer LC1 modulates light passing through the liquid crystal layer LC1 in accordance with a state of the electric field. The directions of the liquid crystal molecules of the liquid crystal layer LC1 are changed with the electric field that is applied between the pixel electrodes 22 and the counter electrode 23, and the transmission amount of light passing through the liquid crystal layer LC1 is thereby changed. Each of the subpixels 49 includes the pixel electrode 22. The switching elements for individually controlling the operations (light transmittances) of the subpixels 49 are electrically coupled to the pixel electrodes 22.

Figure 5:
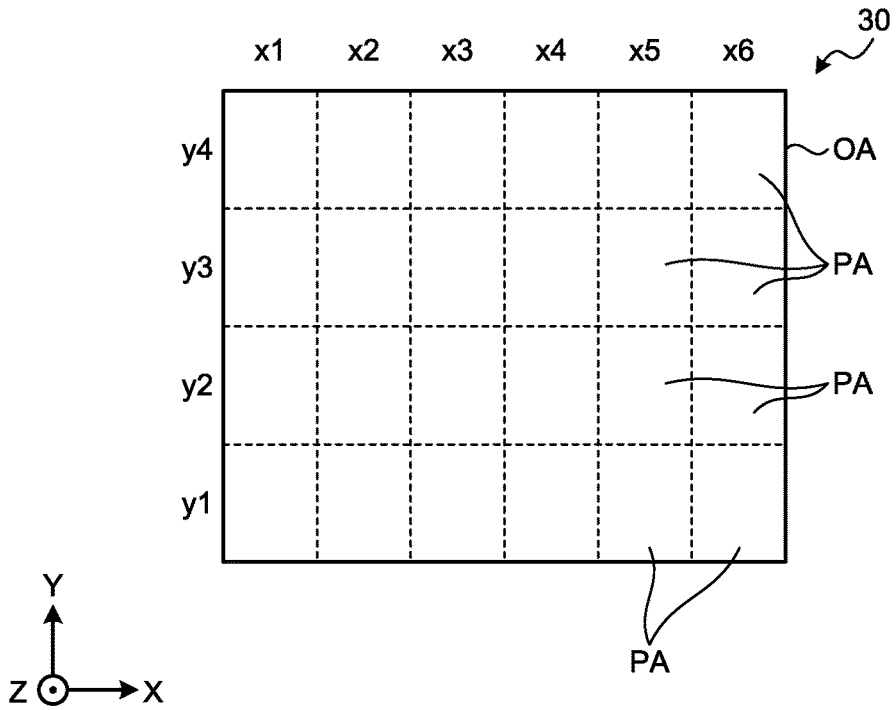
FIG. 5 is a diagram illustrating an example of a relation between a display area and display divided areas.

FIG. 5 is a diagram illustrating an example of a relation between the display area and display divided areas. As illustrated in FIG. 5, the display area OA of the display device 30 has a plurality of display divided areas PA. An area formed by combining all of the display divided areas PA corresponds to the display area OA. The display divided areas PA are arrayed at positions corresponding to coordinates of x1, x2, . . . , and x6 set along the X direction. The display divided areas PA are arrayed at positions corresponding to coordinates of y1, y2, y3 and y4 set along the Y direction. In the example illustrated in FIG. 5, the display area OA includes 24 display divided areas PA in total. The number and arrangement of the display divided areas PA correspond to the number and arrangement of the light control areas LD that the light controller 70, which will be described later, has. One or more pixels 48 are arranged in each of the display divided areas PA.

Figure 6:
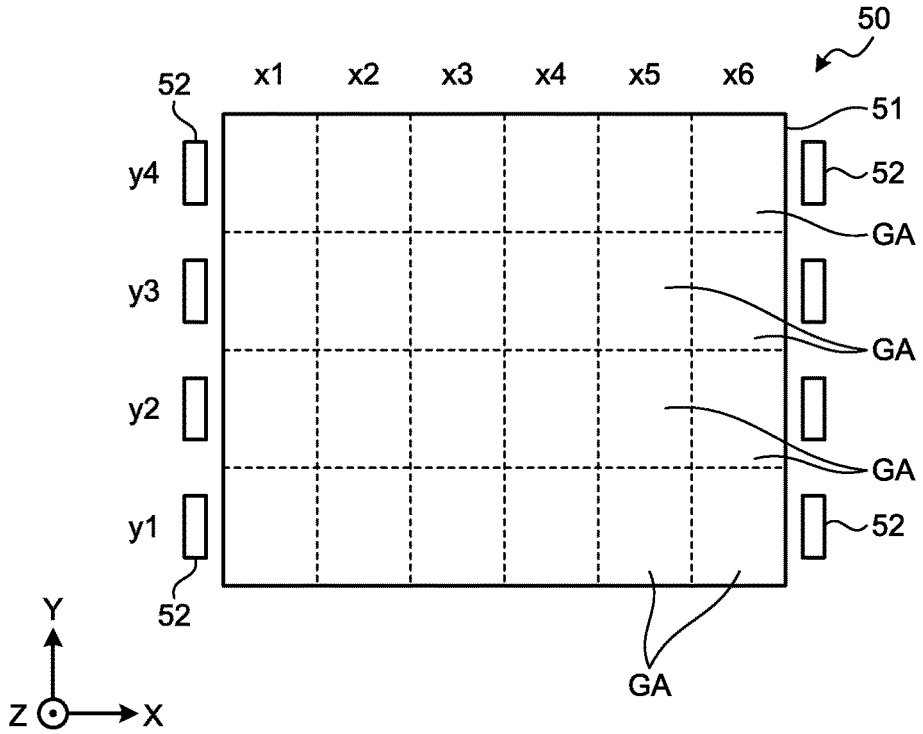
FIG. 6 is a diagram illustrating an example of the main configuration of the illuminator.

FIG. 6 is a diagram illustrating an example of the main configuration of the illuminator. The illuminator 50 includes the light sources 52 positioned on the lateral sides of the display area OA when the display area OA is viewed in plan. The light guiding plate 51 is provided overlapping with the display area OA when viewed in plan. The light sources 52 are provided on both end sides of the light guiding plate 51 in the X direction. The light sources 52 are arrayed along the Y direction on each of one end side and the other end side of the light guiding plate 51 in the X direction. The light sources 52 are, for example, light emitting diodes (LEDs) emitting white light. The light sources 52 are not limited thereto and can be appropriately changed. For example, the light sources 52 may be provided on either the one end side or the other end side of the light guiding plate 51 in the X direction.

The light emitted from the light sources 52 is guided by the light guiding plate 51 and illuminates the entire display area OA from its rear surface side. In FIG. 6, the number of light sources 52 aligned along the Y direction is four, and eight light sources 52 are arranged in total. The illuminator 50 is of a side light type and can therefore be made thinner. This is merely an example of the number and arrangement of the light sources 52; the number and arrangement thereof are not limited thereto and can be appropriately changed. The illuminator 50 may be, for example, what is called a direct backlight. In this case, the light sources 52 are provided just under the light guiding plate 51 while overlapping with the display area OA when viewed in plan. In general, the width (thickness) of a direct backlight-type light source apparatus in the Z direction is much greater than that of the side light-type illuminator 50 using the light guiding plate 51. By contrast, according to the first embodiment, the combined thickness of the illuminator 50 and the light controller 70 can be made less than the thickness of the direct backlight-type light source apparatus.

FIG. 6 schematically illustrates a plurality of light source areas GA in order to indicate a correspondence relation between the light guiding plate 51 and the display area OA. The light source areas GA correspond to the display divided areas PA (see FIG. 5). When the light sources 52 are lit, the light guiding plate 51 guides light from the light sources 52. The light source areas GA emit substantially the same amount of light. The illuminator 50 thereby emits planar light toward the light controller 70 and the display device 30. That is to say, the illuminator 50 in the first embodiment does not control the amount of light to be emitted for each of the light source areas GA and emits the light with a predetermined light amount. The light controller 70 has a function related to control of the light amount.

Figure 7:
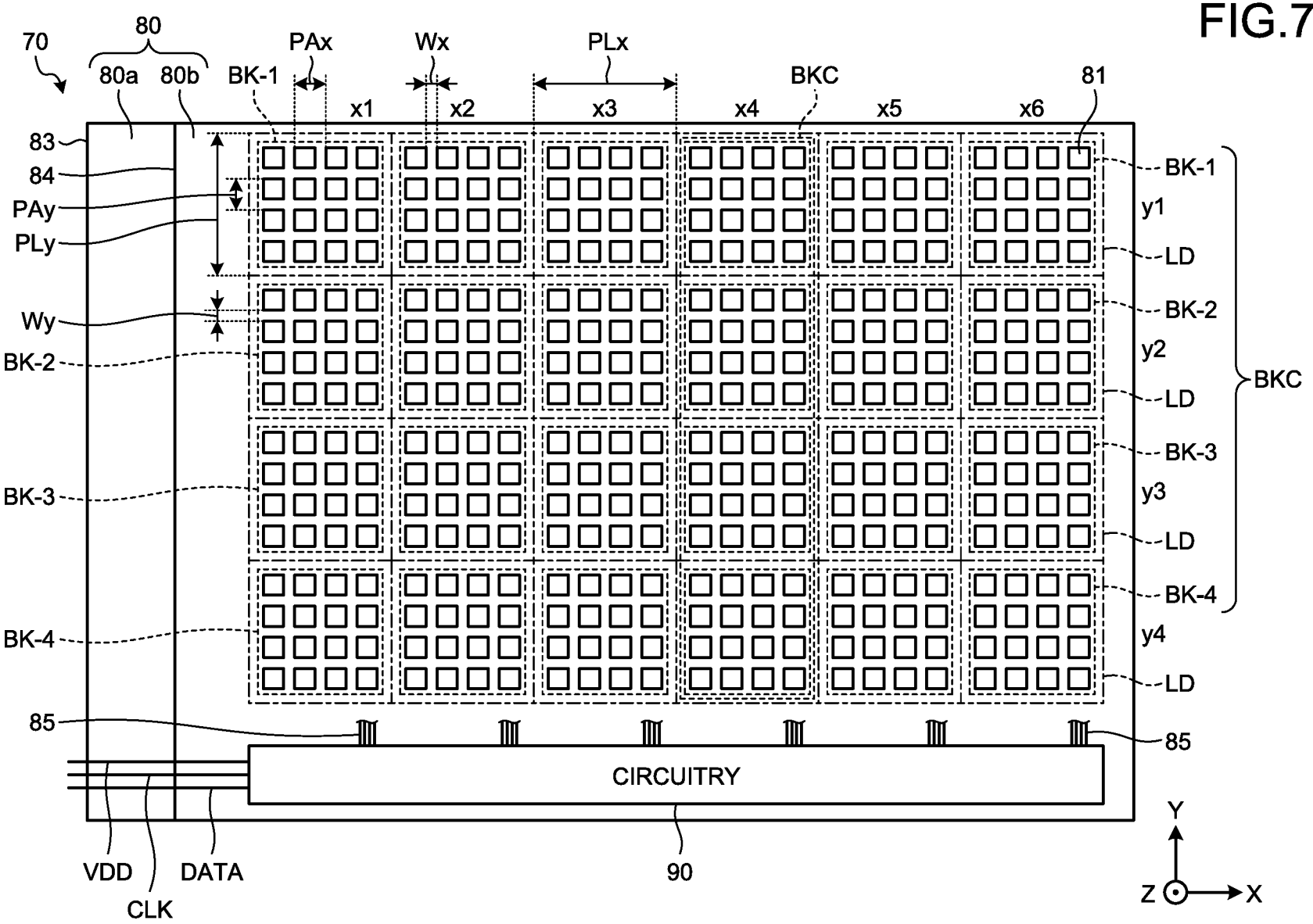
FIG. 7 is a diagram illustrating an example of the main configuration of the light controller.
Figure 8:
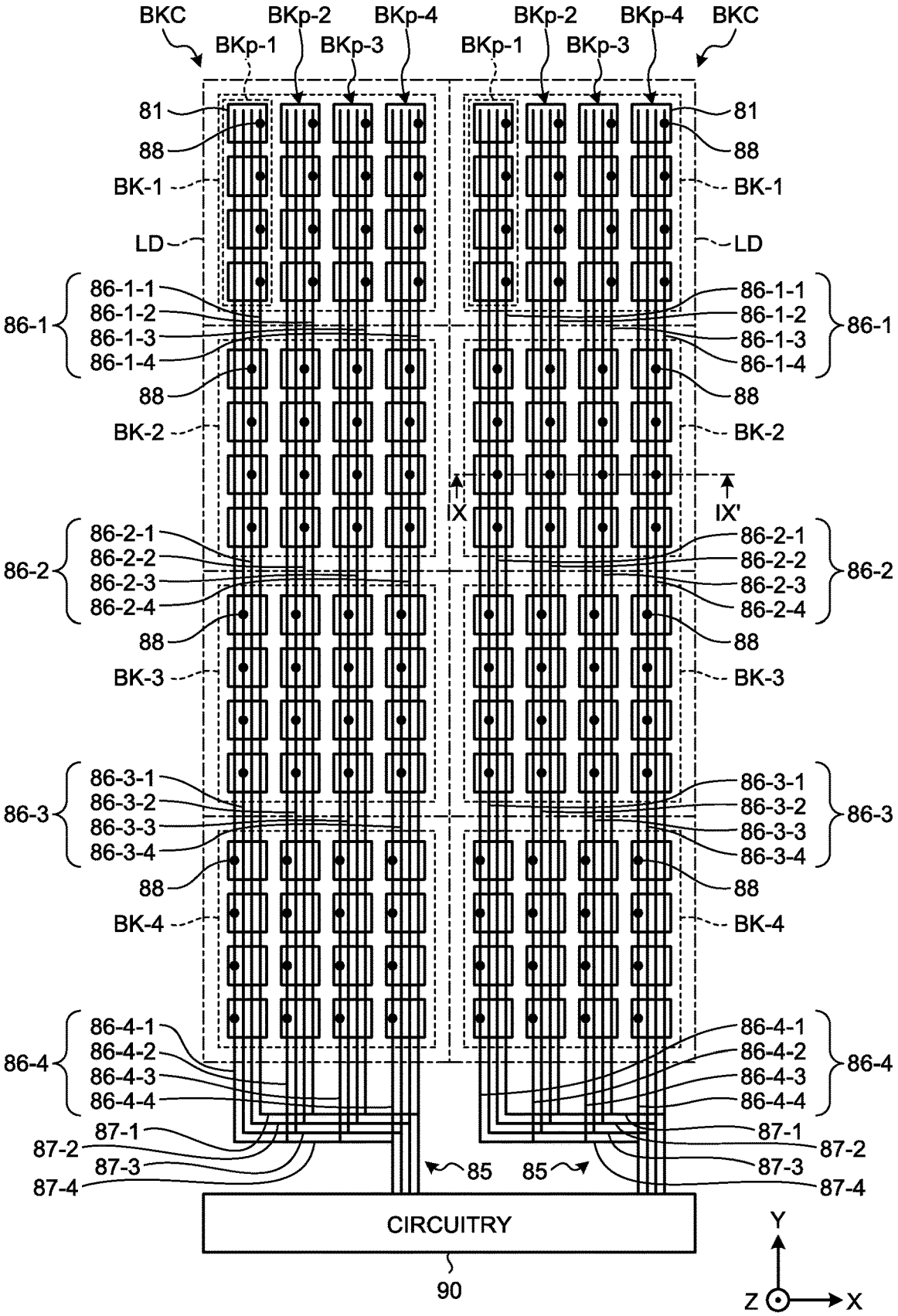
FIG. 8 is a plan view illustrating an example of a coupling relation between first electrodes and wiring lines.
Figure 9:
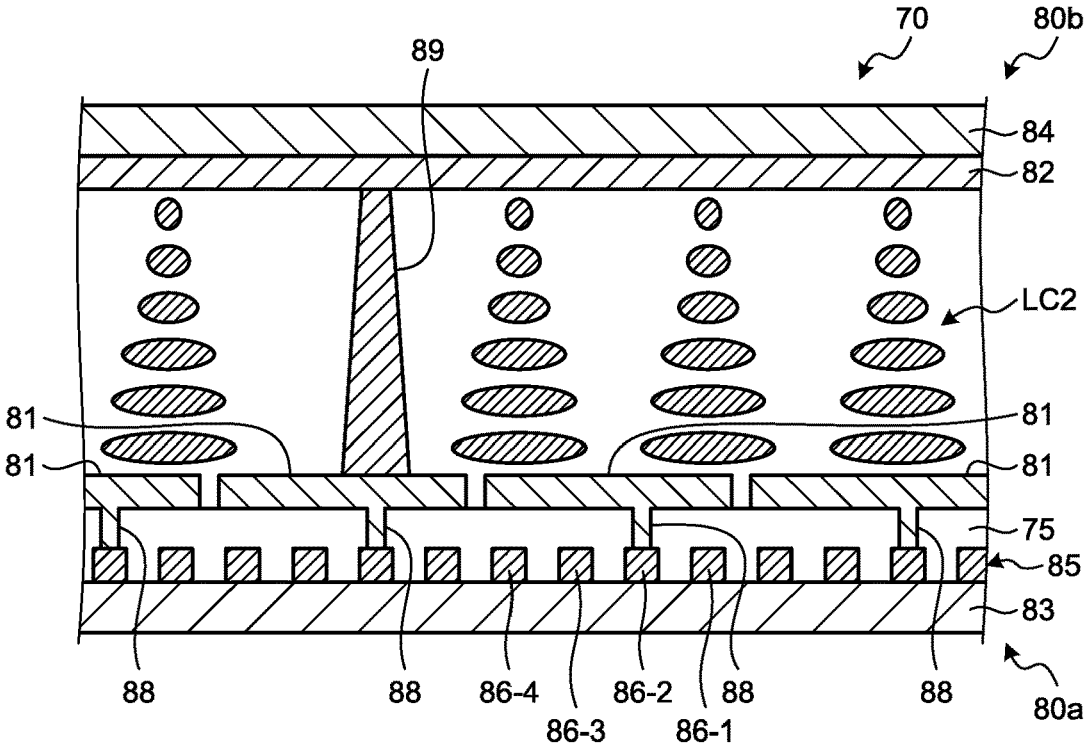
FIG. 9 is a cross-sectional view along line IX-IX' in FIG. 8.

Next, the configuration of the light controller 70 will be described with reference to FIG. 7 to FIG. 10. FIG. 7 is a diagram illustrating an example of the main configuration of the light controller. FIG. 8 is a plan view illustrating an example of a coupling relation between first electrodes and wiring lines. FIG. 9 is a cross-sectional view along line IX-IX' in FIG. 8.

As illustrated in FIG. 9, the lower substrate 80*a* of the light controller 70 includes the first substrate 83, wiring lines 85, an insulating layer 75, and first electrodes 81. The wiring lines 85, the insulating layer 75, and the first electrodes 81 are provided in this order on the first substrate 83. The wiring lines 85 include a plurality of first lines 86 and a plurality of second lines 87 (see FIG. 8). The insulating layer 75 is provided between the wiring lines 85 and the first electrodes 81. Contact holes are provided penetrating in the insulating layer 75 in the thickness direction (Z direction). The first electrodes 81 are coupled to the first lines 86 via couplings 88 provided in the contact holes of the insulating layer 75. The coupling 88 in each contact hole contain a conductive material provided in the contact hole.

The upper substrate 80*b* includes a second substrate 84 and a second electrode 82. The surface of the lower substrate 80*a* on which the first electrodes 81 are provided and the surface of the upper substrate 80*b* on which the second electrode 82 is provided are arranged so as to face each other. The liquid crystal layer LC2 is provided between the surface on which the first electrodes 81 are provided and the surface on which the second electrode 82 is provided. Spacers 89 are provided between the lower substrate 80*a* and the upper substrate 80*b*. The first substrate 83 and the second substrate 84 are, for example, glass substrates. The first electrodes 81, the second electrode 82, and the wiring lines 85 are made of, for example, a conductive material that is made of indium tin oxide (ITO) or the like and has a light transmission property. Alternatively, the first electrodes 81, the second electrode 82, and the wiring lines 85 may be formed by mesh-like metal thin wiring lines.

The second electrode 82 has the configuration that is shared by the light control areas LD (see FIG. 7). To be specific, the second electrode 82 has a flat film shape provided across the entire area of the light control areas LD. The potential of the second electrode 82 is shared by the light control areas LD whereas the potentials of the first electrodes 81 are individually controlled for each of the light control areas LD. The twisting degrees of liquid crystals in the light control areas LD are thereby individually controlled in the liquid crystal layer LC2. Accordingly, the light transmittances of the light control areas LD are individually controlled.

As illustrated in FIG. 7, in the light controller 70 in the embodiment, the light control areas LD are provided in the first substrate 83 in a matrix (row-column configuration). The light control areas LD are arrayed in the X direction and the Y direction parallel to the surface of the first substrate 83. The light control areas LD are arrayed at positions corresponding to the coordinates of x1, x2, . . . , and x6 set along the X direction. The light control areas LD are arrayed at positions corresponding to the coordinates of y1, y2, y3 and y4 set along the Y direction. The light control areas LD are provided overlapping with the display area OA when viewed in plan. The number and arrangement of the display divided areas PA described above correspond to the positions of the light control areas LD. The light control areas LD are provided so as to cover the entire display area OA when viewed in plan.

The first electrodes 81 are arranged in each of the light control areas LD in a matrix (row-column configuration). The first electrodes 81 arranged in one light control area LD are referred to as a first electrode block BK. In other words, an area overlapping with the first electrode block BK containing the first electrodes 81 corresponds to one light control area LD. Each first electrode block BK contains 16 first electrodes 81 in total of four rows and four columns. FIG. 7 is merely an example. The number and positions of the first electrodes 81 contained in the first electrode block BK can be appropriately changed. The first electrode block BK may contain the first electrodes 81 of five or more rows and/or five or more columns, for example. In the first electrode block BK, the number of first electrodes 81 arrayed in the X direction may differ from the number of first electrodes 81 arrayed in the Y direction.

As illustrated in FIG. 7, the first electrode blocks BK arrayed in the Y direction are assumed to be first electrode blocks BK-1, BK-2, BK-3, and BK-4. The first electrode blocks BK-1, BK-2, BK-3, and BK-4 are referred to as the first electrode blocks BK when they are not required to be distinguished from one another. A first electrode block column BKC includes the first electrode blocks BK-1, BK-2, BK-3, and BK-4. The first electrode block columns BKC are arrayed in the X direction.

The circuitry 90 is provided in a frame area of the first substrate 83 outside the light control areas LD. The circuitry 90 is mounted on the frame area by chip on glass (COG), a method in which a circuit is directly formed on a substrate, or the like. Thus, providing the circuitry 90 on the first substrate 83 enables maximum light transmittance in the light control areas LD to be easily enhanced. The circuitry 90 is not limited thereto and a part or the entire of the circuitry 90 may be provided on a wiring substrate (for example, a flexible wiring substrate) coupled to the first substrate 83, an external control substrate, or the like. The circuitry 90 is formed along an area extending in the X direction in the frame area but is not limited thereto and may be formed along an area extending in the Y direction.

The first electrodes 81 are coupled to the circuitry 90 via the wiring lines 85. The circuitry 90 selects the light control area LD based on a power supply voltage VDD, a first control signal DATA, a second control signal CLK, and the like that are received from the outside. The circuitry 90 supplies drive signals VL (see FIG. 10) to the first electrodes 81 for each of the light control areas LD, that is, each of the first electrode blocks BK. In this case, the circuitry 90 supplies the drive signals VL having the same potential to the first electrodes 81 contained in one first electrode block BK. The light controller 70 can control the transmittance of the light passing through the lower substrate 80*a* and the upper substrate 80*b* for each of the light control areas LD.

The circuitry 90 may supply the drive signals VL to the first electrodes 81 for each of the first electrode block columns BKC. In this case, the circuitry 90 supplies the drive signals VL having the same potential to the first electrodes 81 contained in one first electrode block column BKC. The light controller 70 can thereby control the transmittance of the light passing through the lower substrate 80*a* and the upper substrate 80*b* for each of the light control areas LD arrayed in the Y direction.

As illustrated in FIG. 7, the light control areas LD are arrayed at a first area pitch PLx in the X direction. The light control areas LD are arrayed at a second area pitch PLy in the Y direction. The first area pitch PLx and the second area pitch PLy are 1 mm to 5 mm, and are, for example, about 3 mm. The first electrodes 81 are arrayed at a first arrangement pitch PAx in the X direction. The first electrodes 81 are arrayed at a second arrangement pitch PAy in the Y direction. The first arrangement pitch PAx and the second arrangement pitch PAy are 0.1 mm to 0.3 mm, and are, for example, about 200 μm. The first arrangement pitch PAx and the second arrangement pitch PAy are greater than pixel pitches Px and Py of the pixels 48 (see FIG. 1). The first electrodes 81 are arrayed at intervals Wx in the X direction. The first electrodes 81 are arrayed at intervals Wy in the Y direction. The intervals Wx and Wy are, for example, 0.001 mm to 0.01 mm. The first arrangement pitch PAx and the second arrangement pitch PAy may be the same or different. The intervals Wx and Wy may be the same or different.

The first electrodes 81 are arranged in a matrix (row-column configuration) in each of the light control areas LD. Areas in which the first electrodes 81 are provided and areas in which no first electrode 81 is provided are repeatedly arranged at the first arrangement pitch PAx and the second arrangement pitch PAy. This configuration causes a difference in the transmittance between the areas in which the first electrodes 81 are provided and the areas in which no first electrode 81 is provided to be difficult to be visually recognized, as compared with the configuration in which one first electrode 81 is provided in one light control area LD, for example. Accordingly, the light controller 70 in the embodiment can reduce occurrence of moire due to arrangement of the first electrodes 81.

Next, a coupling relation between the first electrodes 81 and the circuitry 90 will be described. FIG. 8 illustrates two first electrode block columns BKC. As illustrated in FIG. 8, the wiring lines 85 include the first lines 86 and the second lines 87. The first lines 86 extend in the Y direction (first direction) and are arrayed in the X direction (second direction) intersecting with the Y direction. The second lines 87 extend in the X direction and are coupled to the first lines 86. The first lines 86 are made of, for example, a conductive material having a light transmission property such as ITO. The second lines 87 may be made of the conductive material having the light transmission property, which is the same material as that of the first lines 86, or may be made of a metal material such as copper and silver.

A predetermined number of the wiring lines 85 are provided for each of the first electrode blocks BK and couples its corresponding first electrode block BK and the circuitry 90. To be specific, a plurality of first lines 86-1 and second lines 87-1 are coupled to the first electrodes 81 of the first electrode blocks BK-1 via the couplings 88. A plurality of first lines 86-2 and second lines 87-2 are coupled to the first electrodes 81 of the first electrode blocks BK-2 via the couplings 88. A plurality of first lines 86-3 and second lines 87-3 are coupled to the first electrodes 81 of the first electrode blocks BK-3 via the couplings 88. A plurality of first lines 86-4 and second lines 87-4 are coupled to the first electrodes 81 of the first electrode blocks BK-4 via the couplings 88.

In one first electrode block BK, the first electrodes 81 arrayed in the Y direction are referred to as a partial block BKp. In FIG. 8, four partial blocks BKp-1, BKp-2, BKp-3, and BKp-4 are arrayed in the X direction.

The first lines 86-1 include four first lines 86-1-1, 86-1-2, 86-1-3, and 86-1-4. The number of first lines 86-1-1, 86-1-2, 86-1-3, and 86-1-4 is equal to the number of first electrodes 81 arrayed in each first electrode block BK in the X direction. The first line 86-1-1 is provided so as to overlap with the first electrodes 81 of the partial block BKp-1. The first line 86-1-1 is coupled to the first electrodes 81 of the partial block BKp-1 via the couplings 88. The partial block BKp-2 is adjacent to the partial block BKp-1 in the X direction. The first line 86-1-2 is provided so as to overlap with the first electrodes 81 of the partial block BKp-2 via the couplings 88. That is to say, the first electrodes 81 of the partial block BKp-2 are coupled to the first line 86-1-2 differing from the first line 86-1-1. Similarly, the first line 86-1-3 is coupled to the first electrodes 81 of the partial block BKp-3. The first line 86-1-4 is coupled to the first electrodes 81 of the partial block BKp-4. The partial block BKp-1 is an example of a first partial electrode block, and the partial block BKp-2 is an example of a second partial electrode block. Among all the first electrodes 81, the first electrodes 81 that are included in the partial block BKp-1 are an example of first partial block electrodes. Among all the first electrodes 81, the first electrodes 81 that are included in the partial block BKp-2 are an example of second partial block electrodes.

The first lines 86-1 are provided so as to overlap with the light control areas LD arrayed in the Y direction. The first lines 86-1 each extend from one outer edge to the other outer edge of the light control area LD in the Y direction. That is to say, the first lines 86-1 extend in the Y direction so as to overlap with the first electrode blocks BK-2, BK-3, and BK-4. The insulating layer 75 (see FIG. 9) is provided between the first lines 86-1 and the first electrode blocks BK-2, BK-3, and BK-4. With the insulating layer 75, the first lines 86-1 are electrically isolated from the first electrode blocks BK-2, BK-3, and BK-4. The first lines 86-1-1, 86-1-2, 86-1-3, and 86-1-4 are coupled to the common second line 87-1. The second line 87-1 is coupled to the circuitry 90.

With the above-mentioned configuration, the first electrodes 81 of the first electrode block BK-1 are coupled to the circuitry 90 via the wiring lines 85 (the first lines 86-1 and the common second line 87-1).

The first electrode blocks BK-2, BK-3, and BK-4 are also coupled to the circuitry 90 via the wiring lines 85 similarly. That is to say, in the first electrode block BK-2, the first lines 86-2 (first lines 86-2-1, 86-2-2, 86-2-3, and 86-2-4) are provided so as to overlap with the respective partial blocks BKp of the first electrode block BK-2. The first lines 86-2 are coupled to the first electrodes 81 of the partial blocks BKp via the couplings 88. The first lines 86-2 are coupled to the common second line 87-2. The second line 87-2 is coupled to the circuitry 90 separately from the second line 87-1.

The light control area LD provided with the first electrode block BK-2, which is assumed to a second light control area, is adjacent, in the Y direction, to the light control area LD provided with the first electrode block BK-1, which is assumed to a first light control area. The second light control area is provided closer to the circuitry 90 in the Y direction than the first light control area is. The first lines 86-2 coupled to the first electrode block BK-2 in the second light control area extend to the position overlapping with the first light control area. The first lines 86-2 are not coupled to the first electrode blocks BK-1, BK-3, and BK-4. Among all the first electrodes 81, the first electrodes 81 that are arranged in the first light control area are an example of first block electrodes. Among all the first electrodes 81, the first electrodes 81 that are arranged in the second light control area are an example of second block electrodes.

The first lines 86-1 coupled to the first electrode block BK-1 in the first light control area extend to the position overlapping with the second light control area.

With this configuration, in the light control areas LD arrayed in the Y direction, the number of the first lines 86 overlapping with the light control area LD closer to the circuitry 90 can be made to be equal to the number of the first lines 86 overlapping with the light control area LD farther from the circuitry 90. This can reduce difference in the arrangement density of the first lines 86 among the light control areas LD and difference in the light transmittance among the light control areas LD.

In the first electrode block BK-3, the first lines 86-3 (first lines 86-3-1, 86-3-2, 86-3-3, and 86-3-4) are provided so as to overlap with the respective partial blocks BKp of the first electrode block BK-3. The first lines 86-3 are respectively coupled to the partial blocks BKp via the couplings 88. The first lines 86-3 are coupled to the common second line 87-3. The second line 87-3 is coupled to the circuitry 90 separately from the second lines 87-1 and 87-2. The first lines 86-3 extend to the positions overlapping with the first electrode blocks BK-1, BK-2, and BK-4.

In the first electrode block BK-4, the first lines 86-4 (first lines 86-4-1, 86-4-2, 86-4-3, and 86-4-4) are provided so as to overlap with the respective partial blocks BKp of the first electrode block BK-4. The first lines 86-4 are respectively coupled to the partial blocks BKp via the couplings 88. The first lines 86-4 are coupled to the common second line 87-4. The second line 87-4 is coupled to the circuitry 90 separately from the second lines 87-1, 87-2, and 87-3. The first lines 86-4 extend to the positions overlapping with the first electrode blocks BK-1, BK-2, and BK-3.

The four first lines 86-4, 86-3, 86-2, and 86-1 are arrayed in this order in the X direction at positions overlapping with one partial block BKp. The array order of the first lines 86-4, 86-3, 86-2, and 86-1 can be appropriately changed. The array order of the first lines 86-4, 86-3, 86-2, and 86-1 may differ partial block BKp by partial block BKp.

The first lines 86-1, 86-2, 86-3, and 86-4 and the second lines 87-1, 87-2, 87-3, and 87-4 are provided for each first electrode block column BKC so as to have the same configurations. With the above-mentioned coupling configuration, the circuitry 90 supplies the drive signal VL (see FIG. 10) to the first electrodes 81 for each of the light control areas LD, that is, each of the first electrode blocks BK. The light controller 70 can thereby control the light transmittance for each of the light control areas LD.

As illustrated in FIG. 9, the spacers 89 are provided above the couplings 88. For example, each of the spacers 89 is provided above its corresponding one of the couplings 88. In the liquid crystal layer LC2, areas with disordered orientation of the liquid crystal molecules in the vicinity of the spacers 89 overlap with areas with disordered orientation of the liquid crystal molecules in the vicinity of the couplings 88. The areas with the disordered orientation of the liquid crystal molecules can be reduced.

On the first substrate 83 illustrated in FIG. 9, dummy wiring lines may be provided overlapping with gaps between the adjacent first electrodes 81. The dummy wiring lines are not coupled to the first lines 86, the first electrodes 81, and the like and is in an electrically floating state. Providing the dummy wiring lines can reduce difference in the transmittance between the areas provided with the first electrodes 81 and the areas provided with no first electrode 81. Furthermore, dummy wiring lines may be provided between the adjacent first lines 86. Providing the dummy wiring lines can reduce difference in the transmittance between the areas provided with the first lines 86 and the areas provided with no first line 86.

Figure 10:
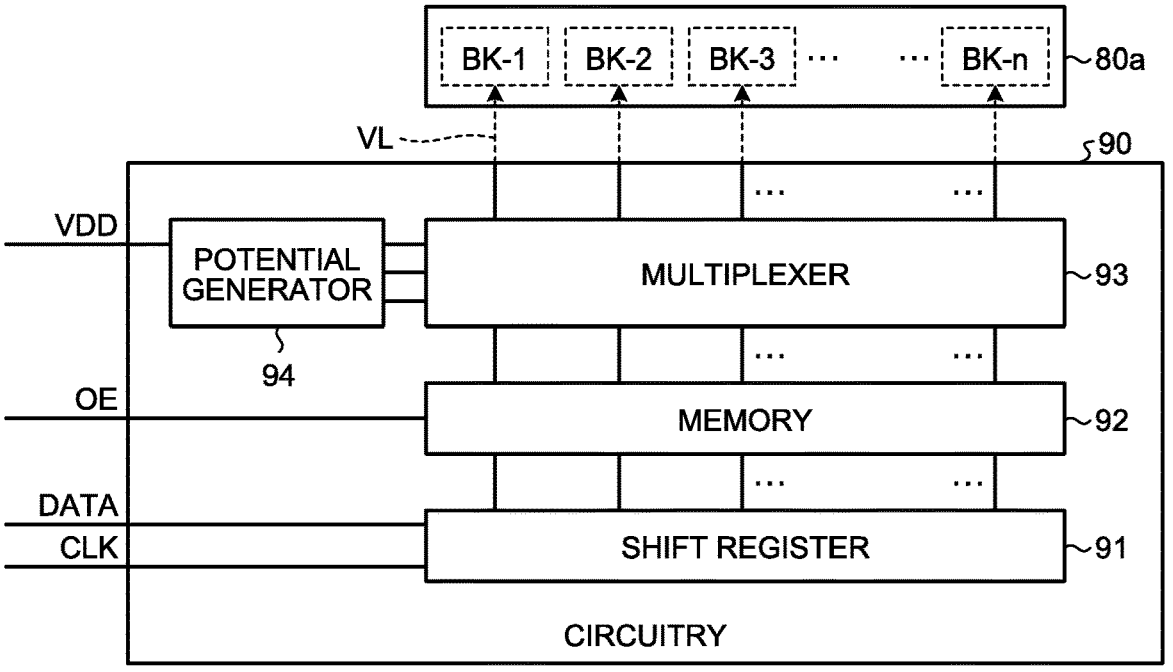
FIG. 10 is a block diagram illustrating an example of the functional configuration of circuitry.

FIG. 10 is a block diagram illustrating an example of the functional configuration of the circuitry. As illustrated in FIG. 10, the circuitry 90 includes a shift register 91, a memory 92, a multiplexer 93, and a potential generator 94.

The shift register 91 is configured by coupling a plurality of sequential circuits (for example, registers) in series. The first control signal DATA and the second control signal CLK are input to the shift register 91. The first control signal DATA is a signal for individually controlling each of the potentials of the first electrode blocks BK. The second control signal CLK is a clock signal for controlling the timing of transfer (shift) of information between the registers of the shift register 91. The shift register 91 outputs electric signals for controlling the potentials of the first electrode blocks BK to the memory 92 in order in accordance with the second control signal CLK.

The memory 92 holds the electric signals output from the shift register 91. The memory 92 is, for example, a static random access memory (SRAM). The memory 92 outputs the electric signals output from the shift register 91 to the multiplexer 93 in accordance with a third control signal OE. The third control signal OE is a signal for controlling information output timing to the multiplexer 93 from the memory 92. The light control signal DI (see FIG. 1) contains the first control signal DATA, the second control signal CLK, and the third control signal OE.

The multiplexer 93 is a switch circuit including a plurality of switch elements. The multiplexer 93 includes, for example, a plurality of TFT elements. The multiplexer 93 supplies the drive signal VL to each of the first electrode blocks BK in accordance with the electric signal output from the shift register 91.

The potential generator 94 is a circuit that receives the power supply voltage VDD and generates one or more potentials in accordance with the light transmittance of each of the light control areas LD. The potential generator 94 outputs, for example, voltage signals having three different potentials to the multiplexer 93. In the example illustrated in FIG. 10, the lower substrate 80*a* has n first electrode blocks BK-1, BK-2, BK-3, . . . , and BK-n in the entire light control areas LD. The voltage signals output from the potential generator 94 are supplied to the first electrode blocks BK-1, BK-2, BK-3, . . . , and BK-n via the multiplexer 93 and the wiring lines 85 (see FIG. 8). The configuration of the circuitry 90 illustrated in FIG. 10 is merely an example and can be appropriately changed.

In the embodiment, the drive signal VL having a potential in accordance with the light transmittance is supplied to each of the first electrode blocks BK by the operation of the circuitry 90. That is to say, switch elements such as TFT elements are not required to be provided in areas overlapping with the light control areas LD. As illustrated in FIG. 8, the first electrode blocks BK arranged in a matrix (row-column configuration) are coupled to the circuitry 90 via the wiring lines 85. With the above-mentioned configuration, the light controller 70 can control the light transmittance for each of the light control areas LD arranged in a matrix (row-column configuration) without providing the switch elements in the light control areas LD.

Second Embodiment

Figure 11:
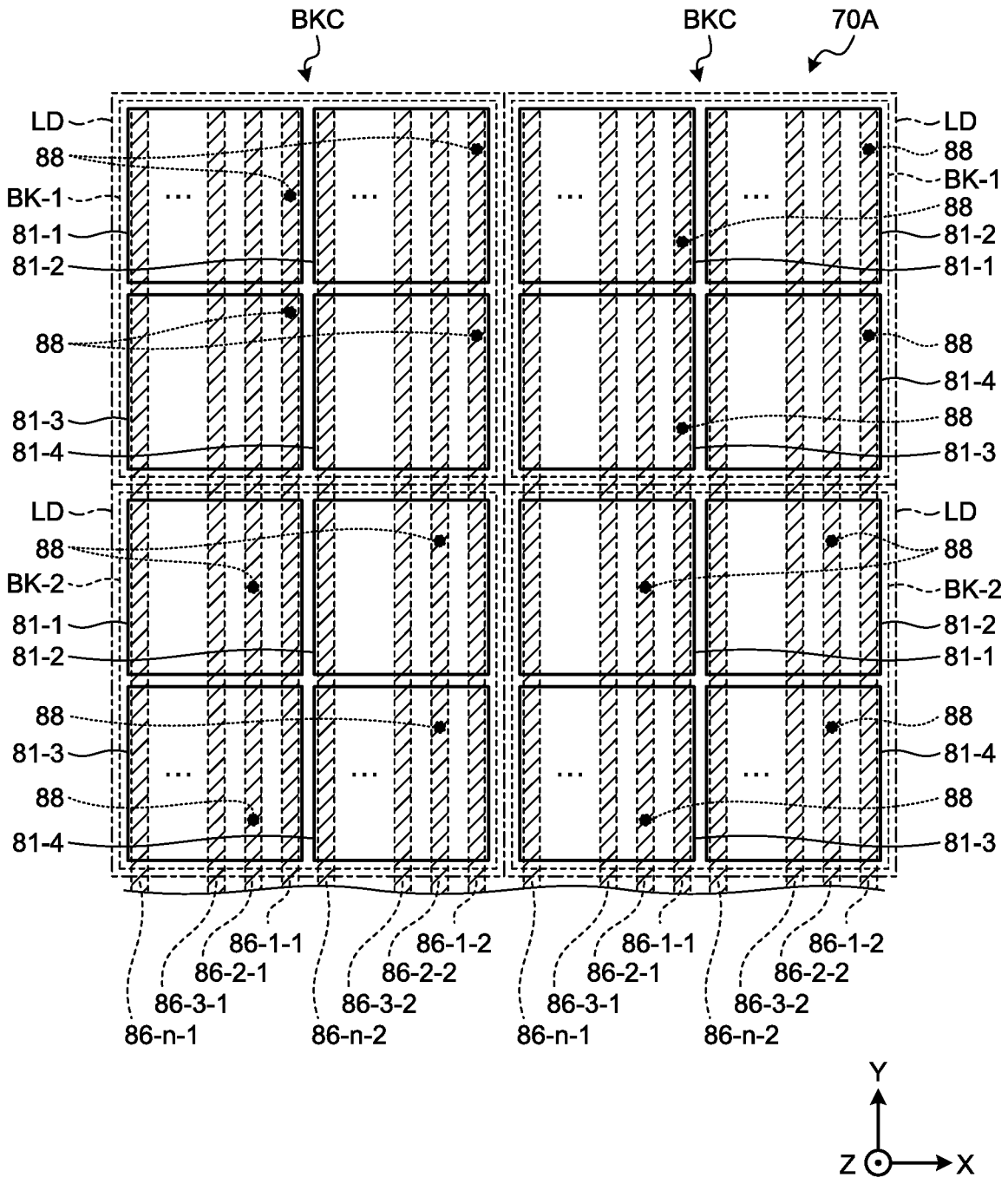
FIG. 11 is a plan view illustrating an example of a coupling relation between first electrodes and wiring lines according to a second embodiment.

FIG. 11 is a plan view illustrating an example of a coupling relation between first electrodes and wiring lines according to a second embodiment. FIG. 11 illustrates four light control areas LD for making the drawing easy to be viewed. FIG. 11 illustrates two first electrode block columns BKC. Each of the first electrode block columns BKC includes two first electrode blocks BK-1 and BK-2. Each of the first electrode blocks BK includes four first electrodes 81-1, 81-2, 81-3, and 81-4. FIG. 11 is merely an example, and four or more first electrodes 81 may be provided in the first electrode block BK and five or more light control areas LD may be provided.

In the first electrode block BK, the first electrode 81-1 is adjacent to the first electrode 81-2 in the X direction. The first electrode 81-1 is adjacent to the first electrode 81-3 in the Y direction. The first electrode 81-3 is adjacent to the first electrode 81-4 in the X direction. In a light controller 70A in the embodiment, the first lines 86-1-1 and 86-1-2 are coupled to the first electrode block BK-1 via the couplings 88 in the same manner as the first embodiment. The first lines 86-2-1 and 86-2-2 are coupled to the first electrode block BK-2 via the couplings 88. In the embodiment, the n first electrode blocks BK-3, . . . , and BK-n (not illustrated in FIG. 11) are arrayed in the Y direction. The first lines 86-3-1, 86-3-2, . . . , **86-*n*-1, and 86-*n*-2 are coupled to the first electrode blocks BK-3**, . . . , and BK-n in the same manner.

As illustrated in FIG. 11, the first electrode 81-1 and the first electrode 81-2 that are adjacent to each other in the X direction differ from each other in a position of the coupling 88 therefor in the Y direction. That is, in the Y direction, the position of the coupling 88 for the first electrode 81-1 and the position of the coupling 88 for the first electrode 81-2 are different. Similarly, the first electrode 81-3 and the first electrode 81-4 that are adjacent to each other in the X direction differ from each other in a position of the coupling 88 therefor in the Y direction. Of the adjacent light control areas LD, the first electrode 81-2 in the light control area LD on the left side in FIG. 11 and the first electrode 81-1 in the light control area LD on the right side in FIG. 11 differ from each other in a position of the coupling 88 therefor in the Y direction. The first electrode 81-4 in the light control area LD on the left side in FIG. 11 and the first electrode 81-3 in the light control area LD on the right side in FIG. 11 differ from each other in a position of the coupling 88 therefor in the Y direction.

Thus, the light controller 70A in the embodiment is configured such that the position of the coupling 88 in the Y direction is different between the adjacent first electrodes 81. The couplings 88 can thereby be prevented from being arrayed along the X direction. Thus, areas having different light transmittances can be prevented from being linearly arrayed and visually recognized, which would be visually recognized due to the couplings 88. The couplings 88 may be arranged such that the positions thereof in the Y direction are random.

Figure 12:
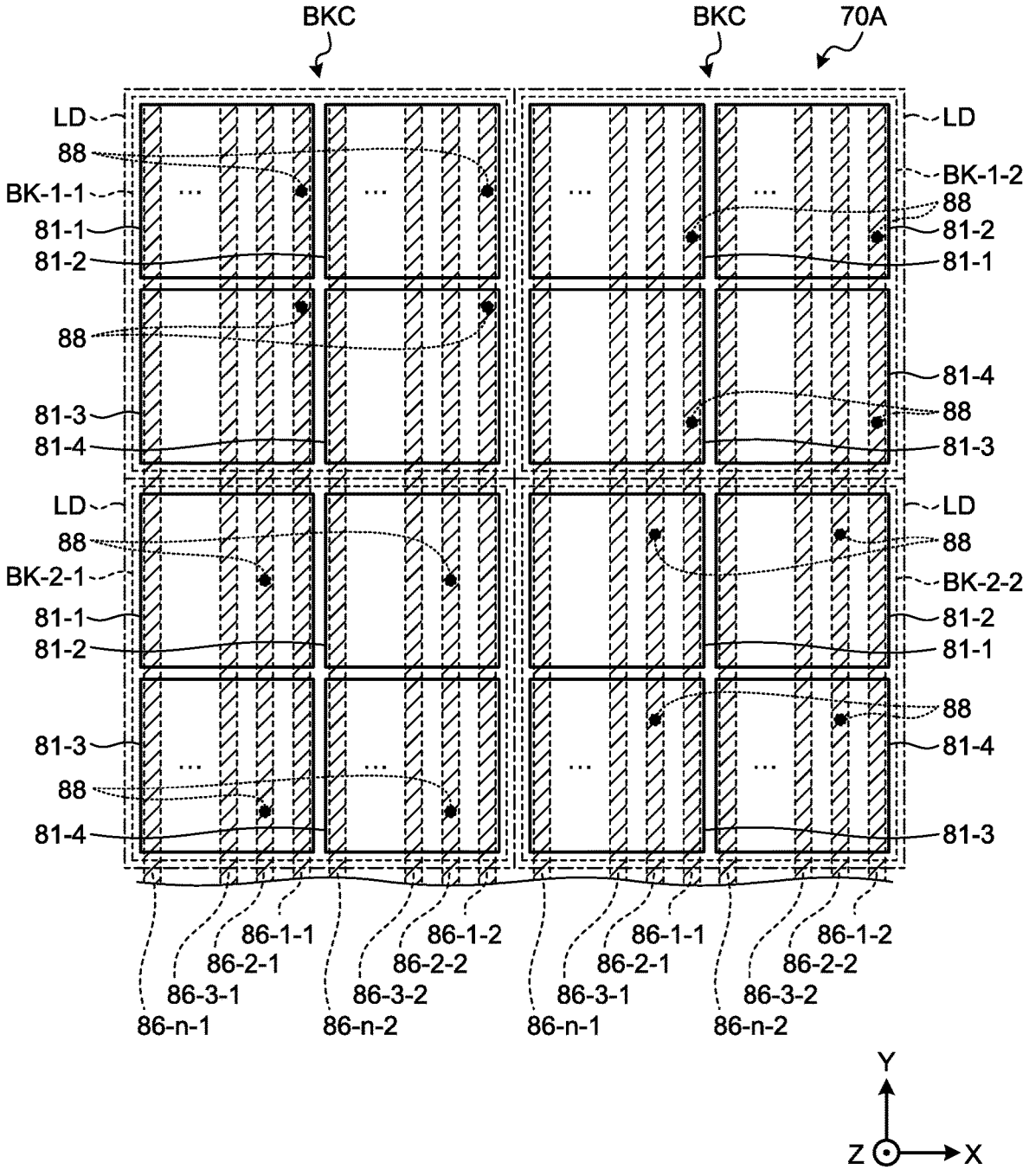
FIG. 12 is a plan view illustrating an example of a coupling relation between the first electrodes and the wiring lines according to a first modification of the second embodiment.

FIG. 12 is a plan view illustrating an example of a coupling relation between the first electrodes and the wiring lines according to a first modification of the second embodiment. In FIG. 12, the first electrode blocks BK-1 adjacent to each other in the X direction are assumed to be a first electrode block BK-1-1 and a first electrode block BK-1-2. The first electrode blocks BK-2 adjacent to each other in the X direction are assumed to be a first electrode block BK-2-1 and a first electrode block BK-2-2. As illustrated in FIG. 12, in the first electrode block BK-1-1, the first electrodes 81-1 and 81-2 adjacent to each other in the X direction are the same in the position of the coupling 88 therefor in the Y direction. Also in the first electrode block BK-1-2, the first electrodes 81-1 and 81-2 adjacent to each other in the X direction are the same in the position of the coupling 88 therefor in the Y direction. The first electrodes 81-1 and 81-2 of the first electrode block BK-1-2 differ from the first electrodes 81-1 and 81-2 of the first electrode block BK-1-1 located in the same row in the position of the coupling 88 therefor in the Y direction.

Figure 13:
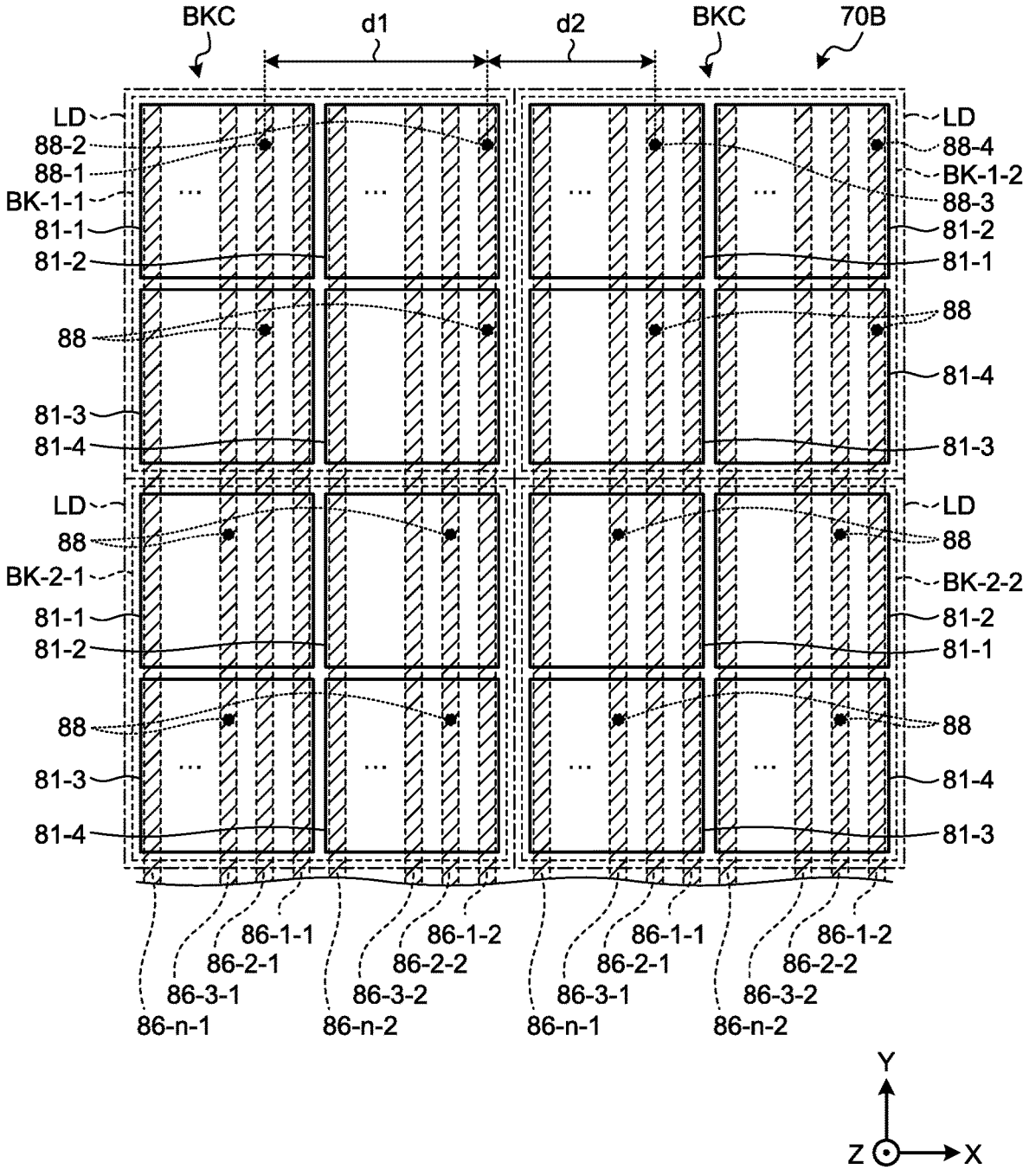
FIG. 13 is a plan view illustrating an example of a coupling relation between the first electrodes and the wiring lines according to a second modification of the second embodiment.

FIG. 13 is a plan view illustrating an example of a coupling relation between the first electrodes and the wiring lines according to a second modification of the second embodiment. In a light controller 70B illustrated in FIG. 13, the couplings 88 are provided such that the positions thereof in the X direction are random. To be specific, as illustrated in FIG. 13, in the first electrode block BK-1-1, the first electrode 81-1 is coupled to a first line 86-2-1 via a first coupling 88-1. In the first electrode block BK-1-1, the first electrode 81-2 is coupled to a first line 86-1-2 via a second coupling 88-2. In the first electrode block BK-1-2, the first electrode 81-1 is coupled to the first line 86-2-1 via a third coupling 88-3.

Three first electrodes 81-1, 81-2, and 81-1 arrayed in the X direction are coupled to different first lines 86 via the first coupling 88-1, the second coupling 88-2, and the third coupling 88-3, respectively. The positions of the first coupling 88-1, the second coupling 88-2, and the third coupling 88-3 in the Y direction are the same. A distance d1 in the X direction between the first coupling 88-1 and the second coupling 88-2 that are adjacent to each other differs from a distance d2 in the X direction between the second coupling 88-2 and the third coupling 88-3 that are adjacent to each other.

In the light controller 70B, the coupling 88 can thereby be prevented from being arrayed at equal intervals in the X direction. Thus, areas having different light transmittances can be prevented from being visually recognized, which would be visually recognized due to couplings 88. The positions of the couplings 88 in the X direction may be randomly arranged. In the first electrode block BK-1 and the first electrode block BK-2 that are adjacent to each other in the Y direction, the couplings 88 are arranged at equal intervals in the X direction. They are not, however, limited to this arrangement. The intervals of the couplings 88 in the X direction may differ between the first electrode block BK-1 and the first electrode block BK-2. Arrangement of the couplings 88 is not limited to the examples illustrated in FIG. 11 to FIG. 13. The couplings 88 may be provided such that, for example, the positions thereof in the X direction are random and the positions thereof in the Y direction are random.

Third Embodiment

Figure 14:
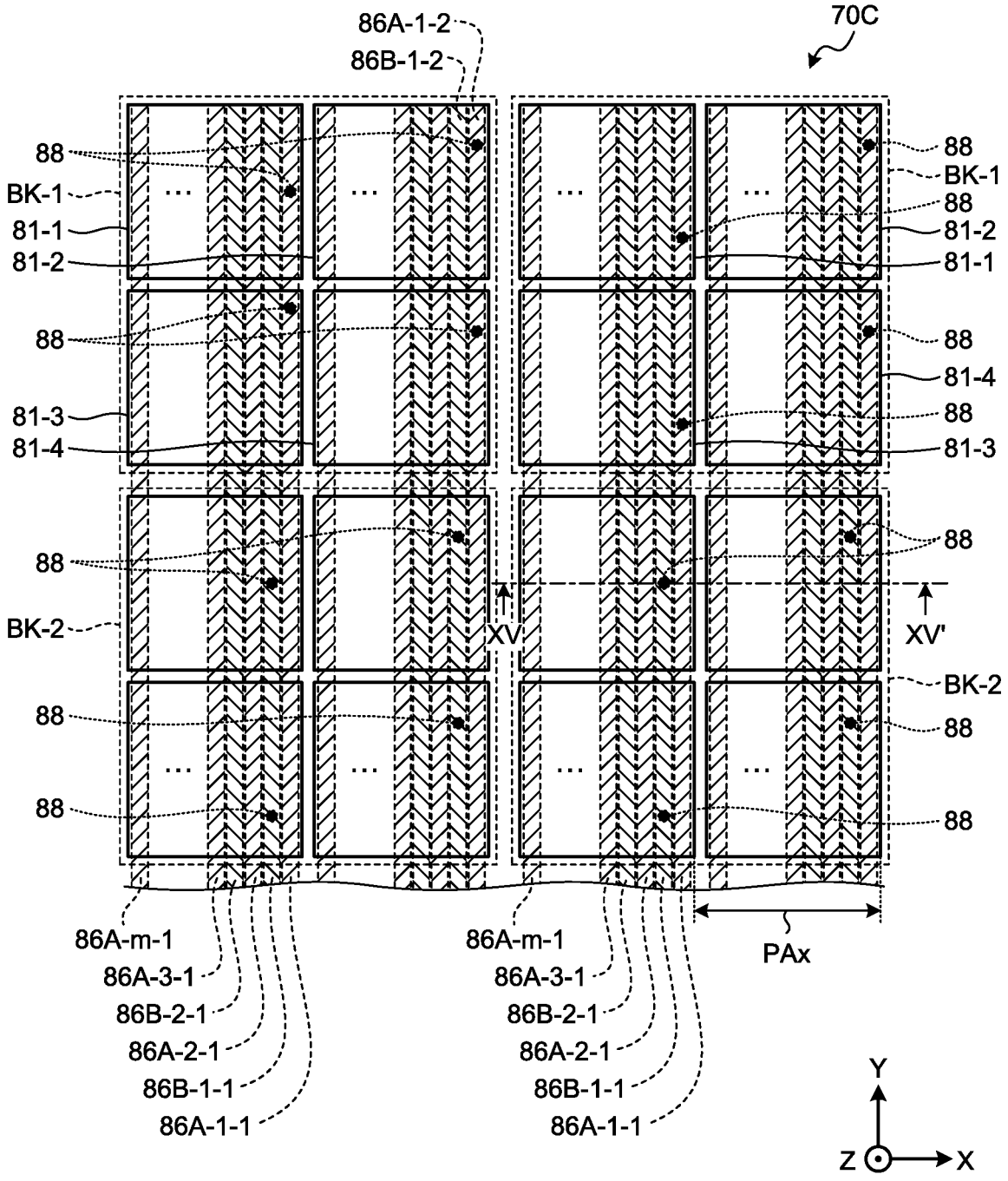
FIG. 14 is a plan view illustrating an example of a coupling relation between first electrodes, first lines, and third lines according to a third embodiment.
Figure 15:
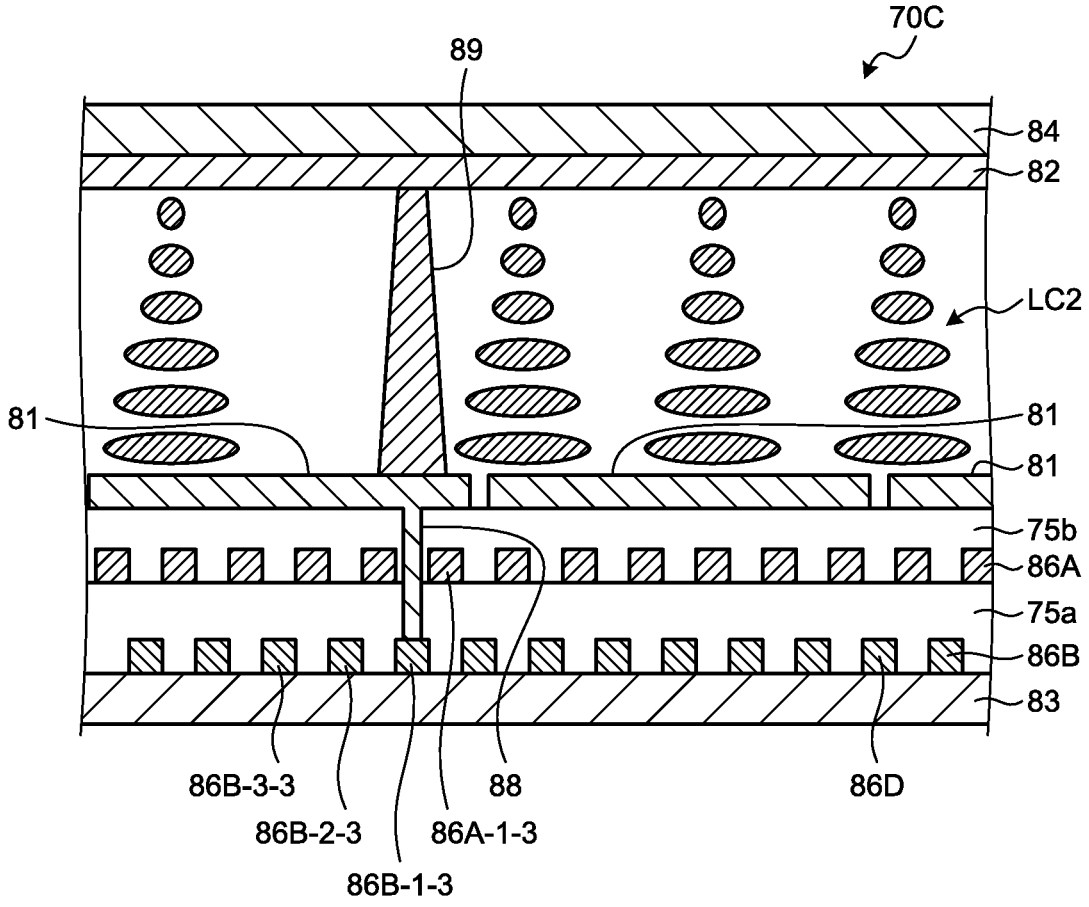
FIG. 15 is a cross-sectional view along line XV-XV' in FIG. 14.

FIG. 14 is a plan view illustrating an example of a coupling relation between first electrodes, first lines, and third lines according to a third embodiment. FIG. 15 is a cross-sectional view along line XV-XV' in FIG. 14. A light controller 70C in the embodiment includes a plurality of first lines 86A and a plurality of third lines 86B. The first lines 86A and the third lines 86B extend in the Y direction and are arrayed in the X direction. The first line 86A and the third line 86B are alternately provided in the X direction when viewed in plan. In other words, the third line 86B is provided between the first lines 86A that are adjacent in the X direction when viewed in plan.

The first lines 86A and the third lines 86B are provided so as to overlap with the first electrode blocks BK-1 and BK-2 that are adjacent in the Y direction. In one first electrode block BK-1, the first lines 86A and the third lines 86B are provided so as to overlap with the first electrodes 81-1 and 81-3 that are adjacent in the Y direction.

In the embodiment, m first lines 86A and (m-1) third lines 86B are alternately arrayed. The first line 86A-1-1 is coupled to the first electrodes 81-1 and 81-3 of the first electrode block BK-1 via the couplings 88. The third line 86B-1-1 is coupled to the first electrodes 81 of the first electrode block BK-2 via the couplings 88. The first line 86A-1-1, the third line 86B-1-1, the first line 86A-2-1, the third line 86B-2-1, the first line 86A-3-1, . . . , and the first line 86A-m-1 are respectively coupled to the different first electrode blocks BK that are arrayed in the Y direction.

The first line 86A-1-2 is coupled to the first electrodes 81-2 and 81-4 of the first electrode block BK-1 via the couplings 88. The third line 86B-1-2 is coupled to the first electrodes 81 of the first electrode block BK-2 via the couplings 88. The first line 86A-1-1 and the first line 86A-1-2 are coupled to the circuitry 90 via the common second line 87 (see FIG. 8). The third line 86B-1-1 and the third line 86B-1-2 are coupled to the circuitry 90 via the common second line 87 (see FIG. 8). In the above-mentioned manner, each of the first electrode blocks BK is coupled to the circuitry 90 via the first lines 86A or the third lines 86B.

As illustrated in FIG. 15, the third lines 86B are provided on the first substrate 83. The first lines 86A are provided on the upper side of the third lines 86B with an insulating layer 75*a* therebetween. The first electrodes 81 are provided on the upper side of the first lines 86A with an insulating layer 75*b* therebetween. Thus, the first lines 86A are provided in a layer different from a layer in which the third lines 86B are provided. As illustrated in FIG. 14, the intervals between the first line 86A and the third line 86B that are adjacent to each other in the X direction when viewed in plan can be decreased.

With this configuration, areas in which neither of the first lines 86A nor the third lines 86B is provided can be reduced in the light control areas LD. This can therefore reduce generation of transmittance distribution due to the first lines 86A and the third lines 86B. Thus, the light controller 70C in the embodiment can reduce occurrence of moire due to repeated arrangement of the first lines 86A and the third lines 86B. Even when the first lines 86A and the third lines 86B are numerous, the first arrangement pitch PAx of the first electrodes 81 can be decreased. A resolution of the light controller 70C can therefore be increased by making the area of one light control area LD small.

As illustrated in FIG. 15, dummy wiring lines 86D are provided overlapping with gaps between the adjacent first electrodes 81. The dummy wiring lines 86D are not coupled to the first lines 86A, the second lines 87 (see FIG. 8), the third lines 86B, the first electrodes 81, and the like and is in an electrically floating state. Providing the dummy wiring lines 86D can reduce difference in the transmittance between the areas provided with the first electrodes 81 and the areas provided with no first electrode 81.

Fourth Embodiment

Figure 16:
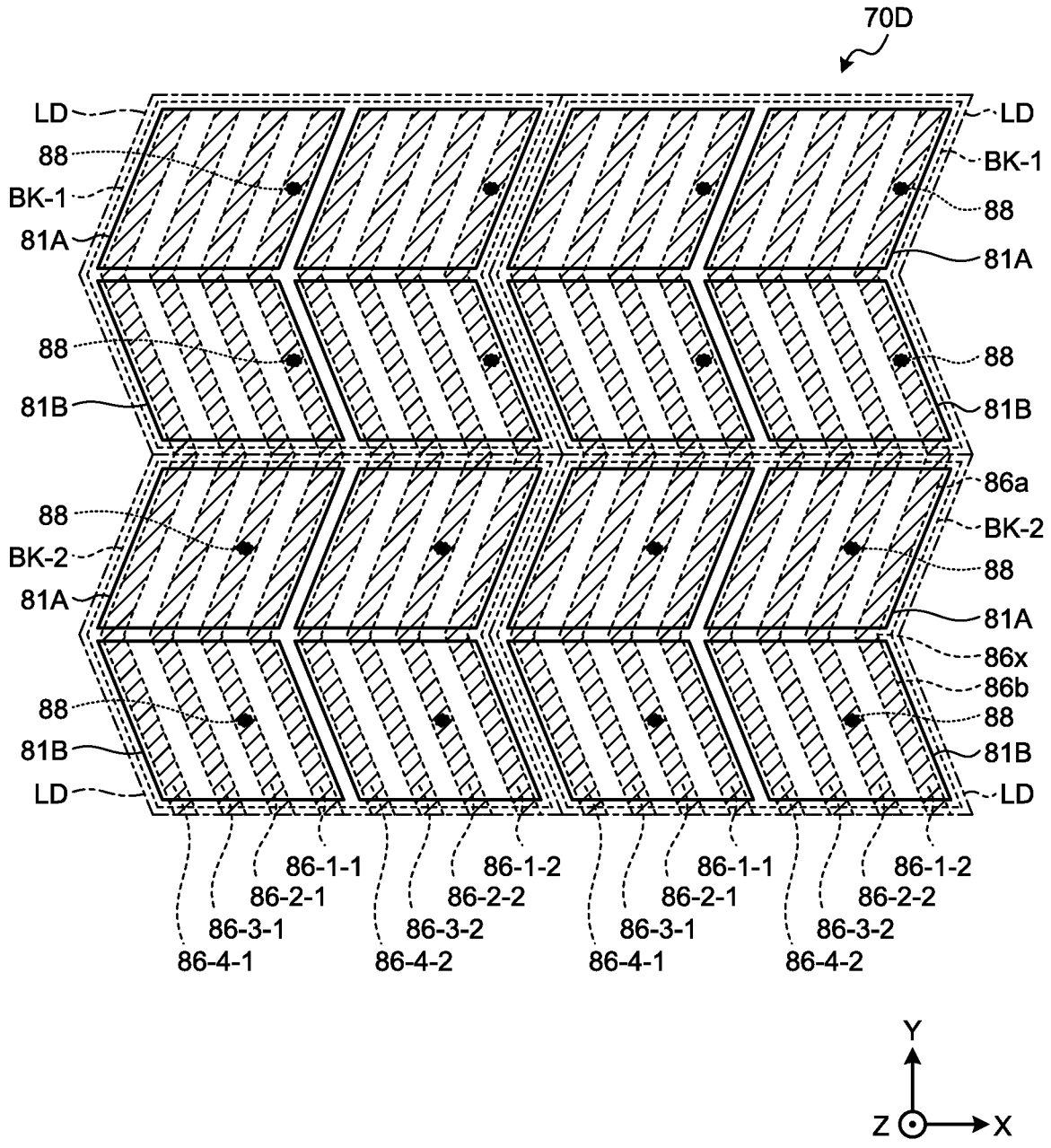
FIG. 16 is a plan view illustrating an example of a coupling relation between first electrodes and wiring lines according to a fourth embodiment.

FIG. 16 is a plan view illustrating an example of a coupling relation between first electrodes and wiring lines according to a fourth embodiment. As illustrated in FIG. 16, a light controller 70D in the embodiment includes first partial electrodes 81A and second partial electrodes 81B. The first partial electrodes 81A are arrayed in the X direction. The second partial electrodes 81B are arrayed in the X direction. The first partial electrode 81A and the second partial electrode 81B are alternately arrayed in the Y direction. The first partial electrode 81A has two sides inclined with respect to the Y direction. The second partial electrode 81B has two sides inclined in a direction differing from that of the two inclined sides of the first partial electrode 81A with respect to the Y direction. The second partial electrode 81B has a shape differing from that the first partial electrode 81A. The first partial electrode 81A and the second partial electrode 81B are arranged so as to be symmetric to each other with respect to a virtual line (not illustrated) parallel to the X direction.

The first lines 86 are zigzag lines and the lengthwise directions thereof as a whole are the Y direction. For example, each of the first lines 86 includes a plurality of first partial lines 86*a*, a plurality of second partial lines 86*b*, and a plurality of bent portions 86*x*. The second partial line 86*b* extends in a direction intersecting with the first partial line 86*a*. The bent portion 86*x* couples the first partial line 86*a* and the second partial line 86*b*.

The first partial line 86*a* extends in a direction intersecting with the X direction and the Y direction. The second partial line 86*b* also extends in a direction intersecting with the X direction and the Y direction. The first partial line 86*a* is provided so as to overlap with the first partial electrode 81A. The first partial line 86*a* extends in a direction along the sides of the first partial electrode 81A. The second partial line 86*b* is provided so as to overlap with the second partial electrode 81B. The second partial line 86*b* extends in a direction along the sides of the second partial electrode 81B. The bent portion 86*x* is located between the first partial electrode 81A and the second partial electrode 81B that are adjacent to each other in the Y direction.

The first electrode block BK includes the first partial electrodes 81A and the second partial electrodes 81B. One light control area LD is an area overlapping with the first electrode block BK. In the embodiment, the first line 86-1-1 is coupled to the first partial electrode 81A and the second partial electrode 81B of the first electrode block BK-1 via the couplings 88. The first line 86-1-2 is coupled to the first partial electrode 81A and the second partial electrode 81B that are adjacent, in the X direction, to the first partial electrode 81A and the second partial electrode 81B coupled to the first line 86-1-1. The first line 86-1-1 and the first line 86-1-2 are coupled to the common second line 87 (see FIG. 8). The first electrode block BK-1 is thereby coupled to the circuitry 90. The first electrode block BK-2 is also coupled to the circuitry 90 with a similar coupling relation.

In the embodiment, the first partial electrodes 81A and the second partial electrodes 81B are formed into shapes illustrated in FIG. 16, so that areas in which neither of the first partial electrode 81A nor the second partial electrode 81B is provided are not formed linearly in the Y direction. This configuration therefore makes it harder for a difference in transmittance between the areas provided with the first partial electrode 81A and the second partial electrode 81B and the areas provided with neither of the first partial electrode 81A nor the second partial electrode 81B to be visually recognized.

The first partial electrodes 81A and the second partial electrodes 81B have a parallelogram shape but may have another shape. The first partial electrodes 81A and the second partial electrodes 81B may have, for example, a rectangular shape, a polygonal shape, or an irregular shape. The shape of each first line 86 is not limited to the zigzag shape and may have another shape such as a wave shape and a linear shape. The first partial electrode 81A and the second partial electrode 81B may be a pair of partial electrodes that constitutes one of the first electrodes 81, or each of the first partial electrode 81A and the second partial electrode 81B may be an individual first electrode 81 of the first electrodes 81.

The preferred embodiments of the present disclosure have been described above. The present disclosure is, however, not limited to the embodiments. The contents disclosed in the embodiments are merely examples and various changes can be made in a range without departing from the gist of the present disclosure. It is needless to say that appropriate changes made in the range without departing from the gist of the present disclosure also belong to the technical range of the present disclosure. Although the circuitry 90 is formed along the substrate side of the light control panel 80 that extends in the X direction in the embodiments, the circuitry 90 is not limited thereto and may be formed along the substrate side thereof that extends in the Y direction. The first lines 86 may extend in the X direction and the second lines 87 may extend in the Y direction.

What is claimed is:

1. A display apparatus comprising:

a display device that includes a display area in which a plurality of pixels are provided;

an illuminator that includes a light guiding plate opposed to the display area and a light source configured to emit light to the light guiding plate; and a light controller configured to adjust an amount of light emitted from the illuminator, wherein the light controller includes:

a first substrate provided with a plurality of light control areas opposed to the display area;

a plurality of electrodes arranged in a matrix in each of the light control areas;

circuitry configured to control light transmittance of each of the light control areas; and a plurality of wiring lines that couple the circuitry and the electrodes, wherein the light control areas are arrayed in a first direction parallel to a surface of the first substrate and in a second direction intersecting with the first direction, wherein the wiring lines includes:

a plurality of first lines that extend in the first direction and are arrayed in the second direction; and a second line that extends in the second direction and is coupled to the first lines wherein the light control areas include a first light control area, wherein first block electrodes of the electrodes are arranged in the first light control area, wherein a first partial electrode block including first partial block electrodes of the first block electrodes arrayed in the first direction is coupled to a first one of the first lines, and wherein a second partial electrode block including second partial block electrodes of the first block electrode arrayed in the first direction is coupled to a second one of the first lines different from the first one of the first lines.

2. The display apparatus according to claim 1, wherein the first block electrodes are coupled to the circuitry via the second line.

3. The display apparatus according to claim 1, wherein the light control areas include a first light control edge area arrayed at one outer edge in the first direction and a second light control edge area arrayed at another outer edge in the first direction, and wherein the first lines extend from the first light control edge area to the second light control edge area.

4. The display apparatus according to claim 1, wherein the light control areas include a third light control area and a fourth light control area, wherein the fourth light control area is provided so as to be adjacent to the third light control area in the first direction and is provided closer to the circuitry than the third light control area is, and wherein one of the first lines coupled to a second block electrode of the electrodes arrayed in the fourth light control area extends to a position overlapping with the third light control area.

5. The display apparatus according to claim 4, wherein one of the first lines coupled to a first block electrode of the electrodes arrayed in the third light control area extends to a position overlapping with the fourth light control area.

6. The display apparatus according to claim 1, wherein the light controller includes a second substrate that faces the first substrate, a liquid crystal layer that is provided between the first substrate and the second substrate, and a spacer that is provided between the first substrate and the second substrate, and wherein the spacer is provided above a coupling between one of the wiring lines and one of the electrodes.

7. The display apparatus according to claim 1, wherein the electrodes are coupled to the first lines via couplings, and wherein the electrodes that are adjacent in the second direction differ from each other in a position of the coupling therefor in the first direction.

8. The display apparatus according to claim 1, wherein the electrodes are coupled to the first lines via couplings, wherein the couplings include at least a first coupling, a second coupling, and a third coupling, wherein three electrodes of the electrodes arrayed in the second direction are respectively coupled to the first lines differing from one another via the first coupling, the second coupling, and the third coupling, and wherein a distance between the first coupling and the second coupling in the second direction differs from a distance between the second coupling and the third coupling in the second direction.

9. The display apparatus according to claim 1, wherein the wiring lines further includes a plurality of third lines that extend in the first direction and are arrayed in the second direction, and wherein each of the third lines is provided between the first lines adjacent to each other in a plan view and is provided in a layer differing from a layer in which the first lines are provided.

10. The display apparatus according to claim 9, wherein one of the electrodes is coupled to one of the third lines, and another one of the electrodes is coupled to one of the first lines adjacent to the one of the third lines.

11. The display apparatus according to claim 1, wherein each of the first lines includes a plurality of first partial lines, a plurality of second partial lines extending in a direction intersecting with the first partial lines, and a plurality of bent portions each coupling one of the first partial lines and one of the second partial lines, wherein each of the electrodes includes a first partial electrode and a second partial electrode, and wherein the first partial electrode overlaps with at least one of the first partial lines, and the second partial electrode overlaps with at least one of the second partial lines and differs from the first partial electrode in shape.

12. The display apparatus according to claim 1, wherein the illuminator, the light controller, and the display device are provided in this order.

13. The display apparatus according to claim 1, wherein an insulating layer is provided between the wiring lines and the electrodes.

14. A display apparatus comprising:

a display device that includes a display area in which a plurality of pixels are provided;

an illuminator that includes a light guiding plate opposed to the display area and a light source configured to emit light to the light guiding plate; and a light controller configured to adjust an amount of light emitted from the illuminator, wherein the light controller includes:

a first substrate provided with a plurality of light control areas opposed to the display area;

a plurality of electrodes arranged in a matrix in each of the light control areas;

circuitry configured to control light transmittance of each of the light control areas; and a plurality of wiring lines that couple the circuitry and the electrodes, wherein the light control areas are arrayed in a first direction parallel to a surface of the first substrate and in a second direction intersecting with the first direction, wherein the wiring lines includes:

a plurality of first lines that extend in the first direction and are arrayed in the second direction; and a second line that extends in the second direction and is coupled to the first lines, wherein the light control areas include a first light control area and a second light control area, and wherein the second light control area is provided so as to be adjacent to the first light control area in the first direction and is provided closer to the circuitry than the first light control area is, and wherein one of the first lines coupled to a second block electrode of the electrodes arrayed in the second light control area extends to a position overlapping with the first light control area.

15. The display apparatus according to claim 14, wherein one of the first lines coupled to a first block electrode of the electrodes arrayed in the first light control area extends to a position overlapping with the second light control area.

16. A display apparatus comprising:

a display device that includes a display area in which a plurality of pixels are provided;

an illuminator that includes a light guiding plate opposed to the display area and a light source configured to emit light to the light guiding plate; and a light controller configured to adjust an amount of light emitted from the illuminator, wherein the light controller includes:

a first substrate provided with a plurality of light control areas opposed to the display area;

a plurality of electrodes arranged in a matrix in each of the light control areas;

circuitry configured to control light transmittance of each of the light control areas; and a plurality of wiring lines that couple the circuitry and the electrodes, wherein the light control areas are arrayed in a first direction parallel to a surface of the first substrate and in a second direction intersecting with the first direction, wherein the wiring lines includes:

a plurality of first lines that extend in the first direction and are arrayed in the second direction; and a second line that extends in the second direction and is coupled to the first lines, wherein the electrodes are coupled to the first lines via couplings, wherein the couplings include at least a first coupling, a second coupling, and a third coupling, wherein three electrodes of the electrodes arrayed in the second direction are respectively coupled to the first lines differing from one another via the first coupling, the second coupling, and the third coupling, and wherein a distance between the first coupling and the second coupling in the second direction differs from a distance between the second coupling and the third coupling in the second direction.

* * * * *